US009445965B2

(12) United States Patent
Mor et al.

(10) Patent No.: US 9,445,965 B2
(45) Date of Patent: Sep. 20, 2016

(54) METHODS FOR TREATING SPINE PATHOLOGIES

(71) Applicant: APOS—MEDICAL AND SPORTS TECHNOLOGIES LTD., Herzliya (IL)

(72) Inventors: Amit Mor, Rehovot (IL); Avi Elbaz, Dimona (IL)

(73) Assignee: APOS-MEDICAL AND SPORTS TECHNOLOGIES LTD., Herzliya (IL)

( * ) Notice: Subject to any disclaimer, the term of this patent is extended or adjusted under 35 U.S.C. 154(b) by 264 days.

(21) Appl. No.: 14/363,414

(22) PCT Filed: Dec. 10, 2012

(86) PCT No.: PCT/IB2012/057129

§ 371 (c)(1),
(2) Date: Jun. 6, 2014

(87) PCT Pub. No.: WO2013/084213

PCT Pub. Date: Jun. 13, 2013

(65) Prior Publication Data

US 2014/0309692 A1 Oct. 16, 2014

Related U.S. Application Data

(60) Provisional application No. 61/568,211, filed on Dec. 8, 2011.

(51) Int. Cl.

| | |
|---|---|
| ***A43B 13/00*** | (2006.01) |
| ***A61H 1/00*** | (2006.01) |
| ***A43B 7/14*** | (2006.01) |
| ***A43B 13/14*** | (2006.01) |

(Continued)

(52) U.S. Cl.

CPC ..... *A61H 1/008* (2013.01); *A43B 7/00* (2013.01); *A43B 7/144* (2013.01); *A43B 7/1445* (2013.01); *A43B 7/38* (2013.01); *A43B 13/145* (2013.01); *A61H 39/04* (2013.01); *A63B 21/0004* (2013.01); *A63B 21/4015* (2015.10); *A63B 22/18* (2013.01); *A63B 26/003* (2013.01); *A61H 2201/165* (2013.01); *A61H 2205/125* (2013.01); *A63B 23/08* (2013.01); *A63B 23/20* (2013.01); *A63B 2022/185* (2013.01); *A63B 2208/0204* (2013.01); *A63B 2209/10* (2013.01)

(58) Field of Classification Search

CPC ..... A43B 13/00; A43B 13/18; A43B 13/28; A43B 13/38; A63B 23/00; A63B 23/08

USPC ..... 33/3 R, 6

See application file for complete search history.

(56) References Cited

U.S. PATENT DOCUMENTS 1,021,142 A * 3/1912 Freeman ..... A43B 5/18 36/7.6
6,115,943 A * 9/2000 Gyr ..... A43B 13/141 36/28

(Continued)

FOREIGN PATENT DOCUMENTS

WO 2012001685 A1 1/2012

*Primary Examiner* — Yaritza Guadalupe-McCall
(74) *Attorney, Agent, or Firm* — Roach Brown McCarthy & Gruber, P.C.; Kevin D. McCarthy

(57) ABSTRACT

A method of treating spine pathologies and related outcomes in a subject in need thereof is provided. The method includes placement of at least two calibrated, differential disturbances or protuberances under the subject's feet.

16 Claims, 13 Drawing Sheets

(51) Int. Cl.

| | |
|---|---|
| ***A63B 26/00*** | (2006.01) |
| ***A43B 7/00*** | (2006.01) |
| ***A61H 39/04*** | (2006.01) |
| ***A63B 21/00*** | (2006.01) |
| ***A63B 22/18*** | (2006.01) |
| ***A43B 7/38*** | (2006.01) |
| *A63B 23/08* | (2006.01) |
| *A63B 23/20* | (2006.01) |

(56) References Cited

U.S. PATENT DOCUMENTS 7,621,057 B1* 11/2009 Julian ..... A43B 13/182 36/27
2003/0140523 A1* 7/2003 Issler ..... A43B 3/0047 36/37
2007/0051020 A1* 3/2007 Tajima ..... A43B 3/0042 36/132
2010/0281710 A1* 11/2010 Killion ..... A43B 7/38 36/27
2010/0281716 A1* 11/2010 Luthi ..... A43B 13/143 36/30 R
2010/0325919 A1* 12/2010 Elbaz ..... A43B 5/18 36/103
2013/0185955 A1* 7/2013 Cheng ..... A43B 13/14 36/28
2014/0309692 A1* 10/2014 Mor ..... A43B 7/144 606/237
2014/0317959 A1* 10/2014 Elbaz ..... A63B 21/0004 36/88
2015/0119767 A1* 4/2015 Mor ..... A43B 7/144 601/28

* cited by examiner

METHODS FOR TREATING SPINE PATHOLOGIES

FIELD OF INVENTION

This invention is directed to; inter alia, methods for treating spinal disorders in a subject.

BACKGROUND OF THE INVENTION

The spinal cord is a long, thin, tubular bundle of nervous tissue and support cells that extends from the brain (the medulla specifically). The brain and spinal cord together make up the central nervous system. The spinal cord extends down to the space between the first and second lumbar vertebrae; it does not extend the entire length of the vertebral column.

The spinal cord functions primarily in the transmission of neural signals between the brain and the rest of the body but also contains neural circuits that can independently control numerous reflexes and central pattern generators. The spinal cord has three major functions: A. Serve as a conduit for motor information, which travels down the spinal cord. B. Serve as a conduit for sensory information, which travels up the spinal cord. C. Serve as a center for coordinating certain reflexes.

Spinal cord pathologies can result from diverse pathologic processes including trauma. Irrespective of the pathogenesis, it can lead to significant impairment of motor, sensory, or autonomic function.

Spinal cord injuries can be caused by trauma to the spinal column, (stretching, bruising, applying pressure, severing, laceration, etc.). The vertebral bones or intervertebral disks can shatter, causing the spinal cord to be punctured by a sharp fragment of bone. Usually, victims of spinal cord injuries will suffer loss of feeling in certain parts of their body. In milder cases, a victim might only suffer loss of hand or foot function. More severe injuries may result in paraplegia, tetraplegia, or full body paralysis below the site of injury to the spinal cord.

Damage to upper motor neuron axons in the spinal cord results in a characteristic pattern of ipsilateral deficits. These include hyperreflexia, hypertonia and muscle weakness.

Lower motor neuronal damage results in its own characteristic pattern of deficits. Rather than an entire side of deficits, there is a pattern relating to the myotome affected by the damage. Additionally, lower motor neurons are characterized by muscle weakness, hypotonia, hyporeflexia and muscle atrophy.

Spinal shock and neurogenic shock can occur from a spinal injury. Spinal shock is usually temporary, lasting only for 24-48 hours, and is a temporary absence of sensory and motor functions. Neurogenic shock lasts for weeks and can lead to a loss of muscle tone due to disuse of the muscles below the injured site.

SUMMARY OF THE INVENTION

In one embodiment, the present invention provides a method of treating a subject afflicted with a spinal pathology comprising the steps of: (a) securing a device to a subject's foot, whereby said device comprises a foot securing mean, a support member operably attached to said securing mean, and a moveable anterior protuberance and a moveable posterior protuberance, said anterior protuberance and said posterior protuberance are ground engaging; (b) calibrating said posterior protuberance and said anterior protuberance to: a balanced position, said balanced position comprises a position whereby said device provides a reduced inversion, a reduced eversion, or both to said subject's foot during the stance phases; and (a) fixing said posterior protuberance and said anterior protuberance to said support member; wherein said subject is able to walk, thereby treating a subject afflicted with a spinal pathology.

In another embodiment, there is provided a method of reducing pain associated with a spinal pathology in a subject afflicted with a spinal pathology, comprising the steps of: (a) securing a device to a subject's foot, whereby said device comprises a foot securing mean, a support member operably attached to said securing mean, and a moveable anterior protuberance and a moveable posterior protuberance, said anterior protuberance and said posterior protuberance are ground engaging; (b) calibrating said posterior protuberance and said anterior protuberance to: a balanced position, said balanced position comprises a position whereby said device provides a reduced inversion, a reduced eversion, or both to said subject's foot during the stance phases; and (c) fixing said posterior protuberance and said anterior protuberance to said support member, wherein said subject is able to walk, thereby reducing pain associated with a spinal pathology in a subject afflicted with a spinal pathology.

In some embodiments, the calibrating comprises adjusting: (a) a resilience of said anterior protuberance, said posterior protuberance, or a combination thereof; (b) a hardness of said anterior protuberance, said posterior protuberance, or a combination thereof; (c) an elasticity of said anterior protuberance, said posterior protuberance, or a combination thereof; (d) or any combination of (a), (b), and (c). In further embodiments, calibrating further comprises balancing timing of heel rise. According to additional embodiments, calibrating comprises adjusting: (a) a height of said anterior protuberance, said posterior protuberance, or a combination thereof; (b) a convexity of said anterior protuberance, said posterior protuberance, or a combination thereof; (c) a weight of said anterior protuberance, said posterior protuberance, or a combination thereof (d) and a combination of (a), (b), and (c).

According to some embodiments, the balanced position further comprises a position whereby a reduced valgus, varus, dorsal or plantar torque about the ankle is exerted by said device on said subject's foot.

According to additional embodiments, the posterior protuberance is a bulbous protuberance, said anterior protuberance is a bulbous protuberance, or both said posterior protuberance and said anterior protuberance are bulbous protuberances.

In further embodiments, the posterior protuberance and the anterior protuberance are moveably mounted to said support member. In some embodiments, the posterior protuberance is movable within a calcaneus support portion of said support member. In further embodiments, the anterior protuberance is movable within phalanges or metatarsals support portion of said support member. In some embodiments, the anterior protuberance, said posterior protuberance, or their combination comprise a cross-section with a shape of a conic section, said conic section comprising at least one of a circle, ellipse, parabola and hyperbola. In another embodiment, the anterior protuberance is shaped differently from said posterior protuberance.

BRIEF DESCRIPTION OF THE DRAWINGS

The present invention will be understood and appreciated more fully from the following detailed description taken in conjunction with the appended drawings in which.

DETAILED DESCRIPTION OF THE INVENTION

Figure 1:
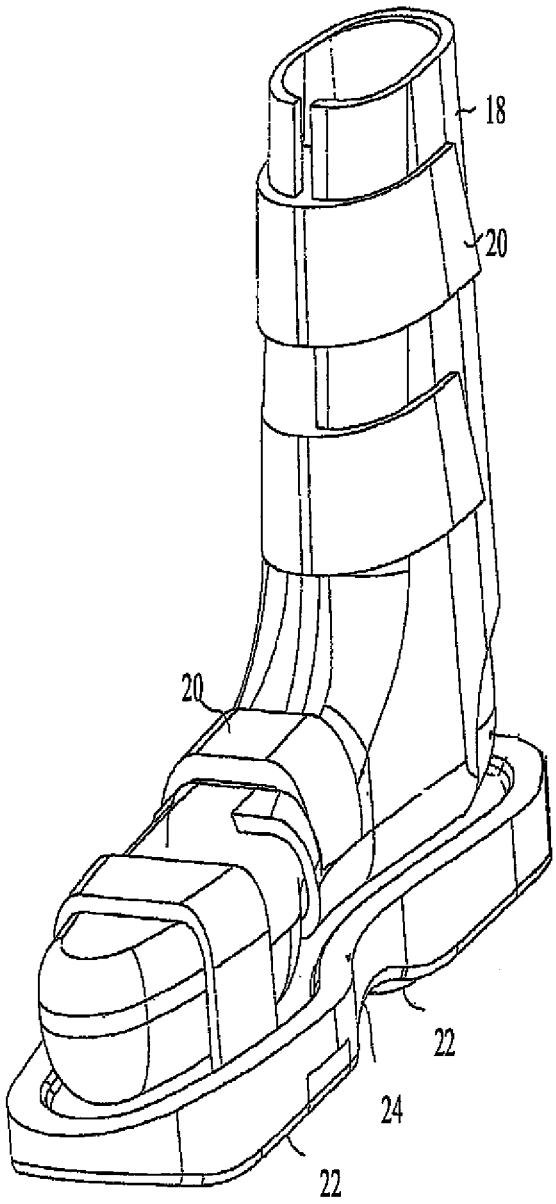
FIG. 1 is a simplified pictorial illustration of footwear constructed and operative in accordance with an embodiment of the present invention

This invention provides, in one embodiment, a method of treating a subject suffering from a spinal disorder, a spinal pathology, a spinal injury, and/or a spinal related pathology comprising the steps of: (a) securing a device to a subject's foot, whereby the device comprises a foot securing mean, a support member operably attached to the securing mean, and a moveable/relocatable anterior protuberance and a moveable/relocatable posterior protuberance, wherein the anterior protuberance and the posterior protuberance are ground engaging; (b) calibrating the posterior protuberance and the anterior protuberance to: a balanced position; and (c) fixing said posterior protuberance and the anterior protuberance to the support member. In some embodiments, a balanced position comprises a position whereby the device provides a reduced inversion, a reduced eversion, or both to the subject's foot during the stance phases.

In another embodiment, the subject is able to walk. In another embodiment, the subject is able to walk with a walking aid such as but not limited to a walking cane. In another embodiment, the subject is able to walk independently. In another embodiment, walk is defined as the act of shifting the balance and base of support from one foot to the other while progressing in a certain direction. Each possibility represents a separate embodiment of the present invention.

In another embodiment, a subject treatable by the methods of the invention can walk. In another embodiment, a subject treatable by the methods of the invention can walk with prosthesis. In another embodiment, a subject treatable by the methods of the invention can walk with leg prosthesis. In another embodiment, a subject treatable by the methods of the invention can walk and has feet or feet like prosthesis to accommodate the device (footwear). Each possibility represents a separate embodiment of the present invention.

In another embodiment, a subject afflicted with a spinal pathology which prevents walking (such as spinal cord injury rated ASIA A, B, or C, condition such as ALS etc.) cannot benefit from the methods of the present invention. In another embodiment, the methods described herein provide treatment for a subject who is able to walk and suffers from any spinal pathology in the nervous system (central and peripheral) or in musculoskeletal structures of the spine and pelvis. Each possibility represents a separate embodiment of the present invention.

In another embodiment, the present invention provides a method of reducing pain associated with a spinal pathology, comprising the steps of: (a) securing a device to a subject's foot, whereby the device comprises a foot securing mean, a support member operably attached to the securing mean, and a moveable/relocatable anterior protuberance and a moveable/relocatable posterior protuberance, the anterior protuberance and the posterior protuberance are ground engaging; (b) calibrating the posterior protuberance and the anterior protuberance to: a balanced position, wherein the balanced position comprises a position whereby the device provides a reduced inversion, a reduced eversion, or both to the subject's foot during the stance phases; and (c) fixing the posterior protuberance and the anterior protuberance to the support member; wherein the subject is able to walk, thereby reducing pain associated with a spinal pathology in a subject afflicted with a spinal pathology. In another embodiment, reduce eversion, inversion, or both is during heel strike, loading response, mid-stance and toe-off.

In another embodiment, walk or walking comprises the stance phases. In another embodiment, stance phases comprise initial contact of foot with ground, loading bodyweight onto the stance leg (loading response), mid-stance, heel off, and push off. Each possibility represents a separate embodiment of the present invention.

In some embodiments, calibration further comprises balanced timing of heel rise. In another embodiment, balancing timing of heel rise comprises correcting instances wherein the heel is pulled off the ground earlier than normal—early-heel rise. In another embodiment, the typical pattern is a whipping motion upwards and medial. In another embodiment, correction comprises lifting a posterior protuberance thus bringing an ankle towards a plantar flexed position. This is done, in some embodiments, by the insertion of a 0.5-8 mm spacer (spacer being a mean for introducing/creating differential height or differential amount of protrusion) between the protuberance and the lower surface 24 or outsole, thus bringing the ankle towards a plantar flexed position. In another embodiment, lifting a protuberance is increasing the height of a protuberance. In another embodiment, in order to reduce the pain in the lumbar region, a hard spacer was attached and fixed between the device and the posterior BP under the left leg and the right legs; this creates a slightly plantar flexed position of both ankles, inducing a more extended position of the lumbar spine. Each possibility represents a separate embodiment of the present invention.

In another embodiment, balancing timing of heel rise comprises correcting instances termed late-heel rise. In another embodiment, late-heel rise is observed as a wobbling medial and lateral rocking motion of the foot. In another embodiment, correction comprises lifting an anterior protuberance thus bringing an ankle towards a slightly more dorsi-flexed position. This is done, in some embodiments, by the insertion of a 0.5-8 mm spacer between the protuberance and the lower surface 24 or outsole, thus bringing the ankle towards a slightly more dorsi-flexed position. Each possibility represents a separate embodiment of the present invention. Each possibility represents a separate embodiment of the present invention.

In another embodiment, the methods disclosed herein are directed to methods of improving the proprioception and/or kinesthetic control in walking in a subject described herein having a spinal pathology. In another embodiment, the methods disclosed herein are based on the unexpected discovery that by changing the center of pressure (COP) with which the foot contacts the ground, spinal pathologies and/or spinal pathologies related effects such as pain or defective gait can be treated and even cured. In another embodiment, changing the center of pressure (COP) with which the foot contacts the ground is executed through calibrating the device (footwear) of the invention. In another embodiment, COP is changed or altered via a perturbation induced by a protuberance as disclosed herein. In another embodiment, a device of the invention alters COP thus changing the movement pattern of a lower limb. In another embodiment, a device of the invention alters COP thus changing the movement pattern of the lower back muscles. In another embodiment, a device of the invention alters COP thus changing the movement or load pattern of the spine and neighboring musculoskeletal tissues. In another embodiment, the methods of the invention provide a controlled change in movement pattern and concomitantly avoiding damage, injury, trauma, or a combination thereof (such as but not limited to: falls, damaging gait, damaging lower limb neuromuscular control or activity) to the subject using the device, thus efficiently enabling the accomplishment of the methods provided herein. Each possibility represents a separate embodiment of the present invention.

In another embodiment, the methods of the invention provide that the subject wearing the device performs activities such as: walking, standing, cooking or getting up from a chair with the device worn on both feet. In another embodiment, the device is footwear comprising at least two protuberances wherein only the protuberances are ground engaging during activities such: walking, standing, cooking or getting up from a chair with the device worn on both feet. In another embodiment, the device is footwear comprising at least two protuberances wherein predominantly the protuberances are ground engaging during activities such: walking, standing, cooking or getting up from a chair with the device worn on both feet. In another embodiment, the device is footwear comprising at least two protuberances wherein only the protuberances are ground engaging during all stance phases. Each possibility represents a separate embodiment of the present invention.

In another embodiment, predominantly is over 50% of the ground engaging period. In another embodiment, predominantly is over 60% of the ground engaging period. In another embodiment, predominantly is over 70% of the ground engaging period. In another embodiment, predominantly is over 80% of the ground engaging period. In another embodiment, predominantly is over 90% of the ground engaging period. In another embodiment, predominantly is over 95% of the ground engaging period. Each possibility represents a separate embodiment of the present invention.

In another embodiment, ground engaging period is the period (time) in seconds wherein part of the footwear is in contact with a ground surface. In another embodiment, ground engaging period is the period (time) in second wherein part of the footwear is in contact with a ground surface during gait and/or stance. Each possibility represents a separate embodiment of the present invention.

Target Populations

In another embodiment, a subject that can benefit from the methods described herein is suffering from spine pathology. In another embodiment, a subject that can benefit from the methods described herein is suffering from spine pathology such as but not limited to: scoliosis, inflammation that targets the joints of the spine, Ankylosing spondylitis (AS), cervical dysfunction, spondylosis, cervical spondylosis, disc prolapse, fibromyalgia syndrome, cervical lymphadenitis, failed back surgery syndrome (FBSS), epidural fibrosis, disc herniation, instability of a segment of spine, reduction in pressure on the nerve root, arachnoiditis, permanent nerve root damage, facet joint disease, back pain or spine pathology, low back pain or spine pathology, degenerative disc disease, ruptured disc, sciatica, brain and spinal cord tumors can be either malignant or benign, spinal cord astrocytoma, syringomyelia, spinal muscular atrophy, kyphosis, or any combination thereof. Each possibility represents a separate embodiment of the present invention. In another embodiment, a subject that can benefit from the methods described herein is suffering from nonspecific back pain. In another embodiment, a subject that can benefit from the methods described herein is suffering from nonspecific neck pain. In another embodiment, nonspecific back or neck pain is chronic (persistent).

In another embodiment, a subject suffering from back pain or spine pathology benefits from the methods of the invention. In another embodiment, a subject suffering from back pain or spine pathology suffers from muscular strain. In another embodiment, a subject suffering from back pain or spine pathology suffers from disk herniation. In another embodiment, a subject suffering from back pain or spine pathology suffers from spondyloarthropathy. In another embodiment, a subject suffering from back pain or spine pathology suffers from AS. In another embodiment, a subject suffering from back pain or spine pathology suffers from sacroiliitis and LE oligoarthritis. In another embodiment, a subject suffering from back pain or spine pathology suffers from scoliosis. In another embodiment, a subject suffering from back pain or spine pathology suffers from hyperlordosis. In another embodiment, a subject suffering from back pain or spine pathology suffers from diskitis. In another embodiment, a subject suffering from back pain or spine pathology suffers from spine stiffness. In another embodiment, a subject suffering from back pain or spine pathology suffers from Staphylococcus aureus infection. In another embodiment, a subject suffering from back pain or spine pathology suffers from vertebral osteomyelitis. In another embodiment, a subject suffering from back pain or spine pathology suffers from acute transverse myelopathy. Each possibility represents a separate embodiment of the present invention.

In another embodiment, a subject suffering from back pain or spine pathology suffers from a primary spinal cord or column tumors (osteogenic sarcoma, neuroblastoma). In another embodiment, a subject suffering from back pain or spine pathology suffers from metastatic tumors (neuroblastoma). In another embodiment, a subject suffering from back pain or spine pathology suffers from bone marrow infiltration (leukemia, lymphoma). In another embodiment, a subject suffering from back pain or spine pathology suffers from menstrual cramps. In another embodiment, a subject suffering from back pain or spine pathology suffers from endometriosis. Each possibility represents a separate embodiment of the present invention.

In another embodiment, a subject suffering from back pain or spine pathology suffers from lower back pain. In another embodiment, a subject suffering from back pain or spine pathology suffers from a musculoligamentous strain. In another embodiment, a subject suffering from back pain or spine pathology suffers from lumbar disc herniation. In another embodiment, a subject suffering from back pain or spine pathology suffers from osteoarthritis. In another embodiment, a subject suffering from back pain or spine pathology suffers from a compression fracture. In another embodiment, a subject suffering from back pain or spine pathology suffers from pyelonephritis. In another embodiment, a subject suffering from back pain or spine pathology suffers from spondylolisthesis. In another embodiment, a subject suffering from back pain or spine pathology suffers from a metastatic cancer. In another embodiment, a subject suffering from back pain or spine pathology suffers from spinal stenosis or central spinal stenosis. In another embodiment, a subject suffering from back pain or spine pathology suffers from a transverse process fracture. In another embodiment, a subject suffering from back pain or spine pathology suffers from pancreatic cancer. In another embodiment, a subject suffering from back pain or spine pathology suffers from sacroiliitis. In another embodiment, a subject suffering from back pain or spine pathology suffers from cauda equina syndrome. In another embodiment, a subject suffering from back pain or spine pathology suffers from vertebral osteomyelitis. In another embodiment, a subject suffering from back pain or spine pathology suffers from an epidural abscess. In another embodiment, a subject suffering from back pain or spine pathology suffers from nerve root irritation. In another embodiment, a subject suffering from back pain or spine pathology suffers from degenerative changes of spinal structures. In another embodiment, a subject suffering from back pain or spine pathology suffers from non specific spinal pain. Each possibility represents a separate embodiment of the present invention.

In another embodiment, a subject suffering from back pain or spine pathology suffers from a radicular pain. In another embodiment, a subject suffering from back pain or spine pathology suffers from ligamentous hypertrophy. In another embodiment, a subject suffering from back pain or spine pathology suffers from deep lumbar muscle spasm. In another embodiment, a subject suffering from back pain or spine pathology suffers from deep trochanteric bursitis. In another embodiment, a subject suffering from back pain or spine pathology suffers from paresthesia. In another embodiment, a subject suffering from back pain or spine pathology suffers from autonomic hyperreflexia. Each possibility represents a separate embodiment of the present invention.

In another embodiment, a subject suffering from spine pathology suffers from a pathology associated with any of the seven cervical vertebras. In another embodiment, a subject suffering from spine pathology suffers from a pathology associated with muscles, ligaments, soft tissues, or any combination thereof that are located in proximity to the spine. In another embodiment, a subject suffering from spine pathology suffers from a neck pain or disorder. In another embodiment, a subject suffering from spine pathology suffers from a neuronal pathology known to be associated with a spinal pathology. In another embodiment, a subject suffering from spine pathology suffers from pain and sensations. In another embodiment, a subject suffering from spine pathology suffers from restricted movement but can still walk. Each possibility represents a separate embodiment of the present invention. Each possibility represents a separate embodiment of the present invention.

In another embodiment, the methods described herein are preformed by calibration of an anterior protuberance a posterior protuberance or both. In another embodiment, the methods described herein involve wearing the device and performing daily activities with it, such as walking, household chores etc. Each possibility represents a separate embodiment of the present invention.

In another embodiment, the posterior protuberance, the anterior protuberance or both are calibrated in both the left and the right footwear to a position in which reduced inversion and/or reduced eversion of the ankle is achieved. In another embodiment, the posterior protuberance, the anterior protuberance or both are calibrated in both the left and the right footwear to a position in which reduced inversion and/or reduced eversion of the foot is achieved. In another embodiment, the posterior protuberance, the anterior protuberance or both are then fixed and the subject is given a treatment plan which details the amount of time the device should be worn per day. The treatment plan also details how much time out of the total wearing time should be spent in weight bearing (i.e. on ones feet). Each possibility represents a separate embodiment of the present invention.

Calibration

In another embodiment, calibrating a protuberance comprises calibrating convexity, calibrating height, calibrating weight, calibrating position, calibrating base diameter or any combination thereof comprises reducing pain, inflammation, improving gait, delaying/stopping the physical deterioration of a subject as described herein, or any combination thereof. In another embodiment, increase in convexity results in differential induction of muscles activity. In another embodiment, increase in convexity results in differential muscle build-up.

In another embodiment, a protuberance of the invention comprises low convexity designated as convexity A, low-medium convexity designated as convexity B, medium convexity designated as convexity C, medium-high convexity designated as convexity D, or high convexity designated as convexity D. In another embodiment, a protuberance of the invention has a base diameter of 55-120 mm. In another embodiment, a protuberance of the invention has a base diameter of 75-100 mm.

In another embodiment, convexity A protuberance has a base diameter of 70-100 mm and a height, which is a perpendicular line connecting the highest point and the base, of 10-13 mm. In another embodiment, convexity B protuberance has a base diameter of 70-100 mm and a height, which is a perpendicular line connecting the highest point and the base, of 14-16 mm. In another embodiment, convexity C protuberance has a base diameter of 70-100 mm and a height, which is a perpendicular line connecting the highest point and the base, of 16-18 mm. In another embodiment, convexity D protuberance has a base diameter of 70-100 mm and a height, which is a perpendicular line connecting the highest point and the base, of 19-22 mm. In another embodiment, the highest point is ground engaging.

In another embodiment, placement (being the function of the initial step of positioning a protuberance according to the invention) and calibration of a protuberance comprises the induction of a differential interference during gait or walking. In another embodiment, the term "interference" comprises disturbance, interruption, interposition, perturbation, obstruction, or any combination thereof. In another embodiment, the ability to fine-tune an induced interference under a foot of a subject enables minimizing inversion and/or eversion as described herein. In another embodiment the balanced position comprises a position whereby the device provides a reduced inversion, a reduced eversion, or both to the subject's feet during the stance phases. Each possibility represents a separate embodiment of the present invention.

Treating

In another embodiment, treating is reducing pain. In another embodiment, treating is alleviating pain. In another embodiment, treating is improving walking speed. In another embodiment, treating is correcting defective gait. In another embodiment, treating is improving defective gait. In another embodiment, treating is improving at least one phase and/or stage of gait such as but not limited to stance and swing phases. In another embodiment, treating is improving at least one phase and/or stage of gait such as but not limited to initial double stance, single limb stance, and/or terminal double limb stance. In another embodiment, treating is correcting scoliosis. In another embodiment, treating is correcting musculoskeletal spine pathology. In another embodiment, treating is improving neuronal spine pathology. In another embodiment, treating is alleviating pain stemming from neuronal spine pathology. In another embodiment, treating is improving posture in a subject afflicted with spine pathology.

In another embodiment, treating is reducing, inhibiting, and/or preventing inflammation that targets the joints of the spine. In another embodiment, treating is reversing cervical dysfunction. In another embodiment, treating cervical dysfunction is reducing neck pain. In another embodiment, treating cervical dysfunction is reducing secondary muscle spasm. In another embodiment, treating is inhibiting and/or reducing chronic pain in the back and/or in the neck. In another embodiment, treating comprises reducing, inhibiting and/or controlling pain. In another embodiment, treating comprises inhibiting the deterioration in musculoskeletal function. In another embodiment, treating comprises increasing musculoskeletal function. In another embodiment, treating comprises restoring the range of motion, flexibility, and/or core strengthening. In another embodiment, treating comprises inhibiting degeneration. In another embodiment, treating comprises reduction in muscular strain. In another embodiment, treating comprises correction of muscle imbalances. In another embodiment, treating comprises the reduction in pain and/or inflammation of the zygapophysial joints/facet joints. In another embodiment, treating comprises reducing and/or inhibiting capsule tissue damage. In another embodiment, treating is reducing and/or inhibiting radicular pain (sciatica). In another embodiment, treating is reducing and/or inhibiting 'non-specific' back pain. Each possibility represents a separate embodiment of the present invention.

In another embodiment, treating is balancing timing of heel rise. In another embodiment, treating is balancing late-heel rise. In another embodiment, treating is balancing early-heel rise. In another embodiment, treating is inhibiting lateral rocking motion of the foot. In another embodiment, treating is improving the proprioception and/or kinesthetic control in a subject. Each possibility represents a separate embodiment of the present invention.

In another embodiment, treating is treating scoliosis comprising reversing abnormal scoliotic curvatures by an average of at least 10%. In another embodiment, treating is treating scoliosis comprising reversing abnormal scoliotic curvatures by an average of at least 20%. In another embodiment, treating is treating scoliosis comprising reversing abnormal scoliotic curvatures by an average of at least 30%. In another embodiment, treating is treating scoliosis comprising reversing abnormal scoliotic curvatures by an average of at least 40%. In another embodiment, treating is treating scoliosis comprising reversing abnormal scoliotic curvatures by an average of at least 50%. In another embodiment, treating is treating scoliosis comprising reversing abnormal scoliotic curvatures by an average of at least 70%. In another embodiment, treating is treating scoliosis comprising reversing abnormal scoliotic curvatures by an average of at least 10%-80%. Each possibility represents a separate embodiment of the present invention.

In another embodiment, treating scoliosis according to the invention prevents bracing. In another embodiment, treating scoliosis comprises treating a patient with bone growth remaining and is generally implemented to hold the curve and prevent it from progressing to the point where surgery is recommended. In another embodiment, treating scoliosis is inhibiting curving during bone growth. In another embodiment, treating scoliosis is treating idiopathic curves. In another embodiment, treating scoliosis is preventing the progression of more severe curves in young children, to buy the child time to grow before performing surgery, which would prevent further growth in the part of the spine affected. In another embodiment, treating scoliosis is treating curves that are less than 50 degrees magnitude. Each possibility represents a separate embodiment of the present invention.

In another embodiment, treating is reducing, inhibiting, and/or preventing inflammation that targets the joints of the spine. In another embodiment, treating is reversing cervical dysfunction. In another embodiment, treating cervical dysfunction is reducing neck pain. In another embodiment, treating cervical dysfunction is reducing secondary muscle spasm. In another embodiment, treating is inhibiting and/or reducing chronic pain in the back and/or in the neck.

In another embodiment, treating spondylosis and/or cervical spondylosis comprises reducing, inhibiting and/or controlling pain. In another embodiment, treating spondylosis and/or cervical spondylosis comprises inhibiting the deterioration in musculoskeletal function. In another embodiment, treating spondylosis and/or cervical spondylosis comprises increasing musculoskeletal function. In another embodiment, treating spondylosis and/or cervical spondylosis comprises restoring the range of motion, flexibility, and/or core strengthening. In another embodiment, treating spondylosis and/or cervical spondylosis comprises inhibiting degeneration.

In another embodiment, treating disc herniation comprises expedited recovery. In another embodiment, treating disc herniation comprises reducing the risk or relapse. In another embodiment, treating disc herniation comprises reducing pain and/or alleviating acute pain. In another embodiment, treating disc herniation comprises stabilizing of a segment of spine. In another embodiment, treating disc herniation comprises reduction in pressure on the nerve root. In another embodiment, treating disc herniation comprises reducing permanent nerve root damage.

In another embodiment, the methods as described herein involve exercise with the device as described herein. In another embodiment, exercise is walking or any other form of gait movement. In some embodiments, exercise comprises standing. In another embodiment, treating is curing the indication provided herein. Each possibility represents a separate embodiment of the present invention.

In another embodiment, the methods as described herein further comprises a combination treatment comprising the use of the device as described herein and a proper medication. In another embodiment, the methods as described herein can be utilized prior to surgery or after surgery. In another embodiment, the methods as described herein are used for rehabilitation of a subject in need thereof. In another embodiment, one of skill in the art will readily diagnose and prescribe the proper medication to a subject suffering from a disease or a condition such as described herein.

In another embodiment, the outcome of treatment as provided herein is apparent immediately after the initial use of the device as described herein. In another embodiment, the outcome of treatment as provided herein is apparent after 10-1000000 meters of walking with the device as described herein. In another embodiment, the outcome of treatment as provided herein is apparent after 50-100000 meters of walking with the device as described herein. In another embodiment, the outcome of treatment as provided herein is apparent after 500-10000 meters of walking with the device as described herein. In another embodiment, the outcome of treatment as provided herein is apparent after 500-5000 meters of walking with the device as described herein. In another embodiment, the outcome of treatment as provided herein is apparent after 500-3000 meters of walking with the device as described herein. Each possibility represents a separate embodiment of the present invention.

In another embodiment, a device as disclosed herein has an immediate effect with regard to treating or treatment of a disease, a pathology, and/or pain as provided herein. In another embodiment, short term immediate effect is apparent after walking with the device for 1-5 days. In another embodiment, short term immediate effect is apparent after walking with the device for 30-600 minutes. In another embodiment, short term immediate effect is apparent after walking with the device for 1-10 hours (hrs). In another embodiment, short term immediate effect is apparent after walking with the device for 5-1000 hours (hrs). In another embodiment, short term immediate effect is apparent after walking with the device for 12-96 hours (hrs). In another embodiment, short term immediate effect is apparent after walking with the device for 1-10 days. In another embodiment, short term immediate effect is apparent after walking with the device for 7-21 days. In another embodiment, short term immediate effect is apparent walking with the device for 5-30 days. Each possibility represents a separate embodiment of the present invention.

In another embodiment, the effect is apparent after walking with the device for 1-2 months. In another embodiment, the effect is apparent after walking with the device for 1-24 months. In another embodiment, the effect is apparent after walking with the device for 2-6 months. In another embodiment, the effect is apparent after walking with the device for 4-10 months. In another embodiment, the effect is apparent after walking with the device for 6-48 months. In another embodiment, the effect is apparent in after walking with the device for 12-24 months. In another embodiment, the effect is apparent after walking with the device for 10-30 months. Each possibility represents a separate embodiment of the present invention.

In another embodiment, a device as described herein is prescribed to a subject according to the subject's physical condition. In another embodiment, a device as described herein is prescribed to a subject according to the subject's medical condition. In another embodiment, a device as described herein is prescribed to a subject according to the subject's medical history. In another embodiment, prescription includes directions of how to use the device. In another embodiment, prescription includes intensity of use, daily use, or daily distance directions.

In another embodiment, any prescription as described herein comprises increase in daily usage time as the subject's gait improves. In another embodiment, any prescription as described herein comprises increase in daily usage time as subject's incontinence/pain decreases. In another embodiment, any prescription as described herein comprises increase in daily usage time as subject's disease or condition as described herein, improves. In another embodiment, a prescription as described herein further comprises medicating the subject according to his or hers medical condition. Each possibility represents a separate embodiment of the present invention.

In another embodiment, a prescription as described herein further comprises adjustments of the device as subject's lower limb muscles are tuned or are off balance. In another embodiment, adjustments of the device comprise calibrating or positioning a protuberance as described herein. Each possibility represents a separate embodiment of the present invention.

The Device

In another embodiment, the device is secured to a subject's foot directly. In another embodiment, the term "secured to a subject's foot" comprises securing the device to any footwear such as but not limited to shoes, boots, etc that are secured to a subject's foot. In another embodiment, a foot securing means secures the device such as footwear 10 to a subject's foot. In another embodiment, various different foot securing means can be used. In another embodiment, a foot securing mean comprises a plurality of securing means. In another embodiment, a foot securing mean is a lace. In another embodiment, a foot securing mean comprises a Velcro fastener. In another embodiment, a foot securing mean comprises securing straps. In another embodiment, reference is made to FIGS. 1-4, which illustrate footwear 10 constructed and operative in accordance with an embodiment of the present invention. Each possibility represents a separate embodiment of the present invention.

In another embodiment, the device is footwear comprising a shoe structure which includes at least two calibrated, disturbances in the form of protuberances under the patient's feet. In another embodiment, the shoe structure serves as a platform for placing at least two calibrated, differential disturbances or protuberances under the patient's feet.

In another embodiment, the upper part of the shoe structure serves as fastening or securing means/platform, while the sole is a platform for placing at least two calibrated, differential disturbances or protuberances under the patient's foot. In another embodiment, the outsole is a platform for placing at least two calibrated, differential disturbances or protuberances under the patient's foot.

In another embodiment, a support member is operably attached to the securing mean. In another embodiment, operably attached comprises sufficient attachment between the securing mean and the support member. In another embodiment, a support member comprises the sole. In another embodiment, a support member comprises the inner sole. In another embodiment, a support member comprises the outer sole. In another embodiment, a support member comprises the middle sole. In another embodiment, a support member comprises the upper (the part of the shoe that is on top of the foot). In another embodiment, the upper is operably attached to the securing mean (such as but not limited to laces). In another embodiment, the upper comprises straps or totally enclosing the foot). In another embodiment, the upper comprises straps that function as securing means (such as sandals). Each possibility represents a separate embodiment of the present invention.

In another embodiment, a device such as footwear 10 is supplied as one or more pairs of shoe-like devices, or alternatively, as just one of the shoe-like devices. In another embodiment, footwear 10 comprises a support member 12 having a periphery in a shape of a shoe sole comprising an upper surface 14. In the illustrated embodiment, the upper surface 14 is indented with a peripheral ridge 16, but it is appreciated that other configurations of upper surface 14 are within the scope of the invention. In another embodiment, footwear 10 is attached to a foot of a user by means of a boot 18 and/or fasteners 20, such as but not limited to, VELCRO straps, buckles, shoe laces, and the like. In another embodiment, footwear 10 is attached to a foot of a user by means of a shoe. In another embodiment, a shoe comprises a platform of a sneaker. In another embodiment, the term sneaker comprises a boot. In another embodiment, the term sneaker comprises a walking boot. In another embodiment, a shoe comprises a platform of a running shoe. In another embodiment, a shoe comprises a platform of an elegant shoe. In another embodiment, a shoe comprises a platform of a walking shoe or boot. Each possibility represents a separate embodiment of the present invention.

In another embodiment, a device such as but not limited to boot 18 is fashioned for attachment to the user's foot with or without fasteners 20. In another embodiment, fasteners 20 are used as foot securing means to attach footwear 10 to the user's foot without boot 18. Each possibility represents a separate embodiment of the present invention.

BP

In another embodiment, the invention provides that the device such as footwear 10 comprises protuberances (BPs) in a fixed position. In another embodiment, the invention provides that the device such as footwear 10 comprises protuberances having any shape known to one of skill in the art. In another embodiment, the invention provides that the device comprises at least two bulbous protuberances. In another embodiment, a protuberance is symmetrical. In another embodiment, a protuberance is asymmetrical In another embodiment, a protuberance comprises a shape of a: polygon, decagon, digon, dodecagon, nonagon, henagon hendecagon, heptagon, hexadecagon, hexagon icosagon, octagon, pentagon, triangle, Penrose tile, trapezium, isosceles, trapezium undecagon, quadrilateral, Lozenge, rhomboid, rectangle, square, rhombus, trapezoid, polydrafter, arbelos, circle, disc, circle, excircle, crescent, dome, ellipse, lune, oval, sphere, asteroid, or deltoid.

In another embodiment, each protuberance 22 has a curved outer contour 26. In another embodiment, each protuberance has a different curved outer contour. In another embodiment, each protuberance 22 has a convexity.

In another embodiment, a protuberance comprises a dome shape. In another embodiment, a protuberance as described herein comprises a dome shape which further comprises multiple different convexities. In another embodiment, each protuberance 22 comprises a different convexity. In another embodiment, each protuberance 22 comprises a different set of convexities. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. Each possibility represents a separate embodiment of the present invention.

In another embodiment, the contours 26 may have the shape of a conic section, that is, the shape of a circle, ellipse, parabola or hyperbola. The various cross-sections of the contours 26 of protuberance 22 may be shaped identically or differently. In another embodiment, the shape of a protuberance is defined by equal arches. In another embodiment, the shape of a protuberance is defined by a variety of arches of different radiuses which are tangent to each other. In another embodiment, the shape of a protuberance is symmetrical. In another embodiment, the shape of a protuberance is asymmetrical. In another embodiment, a protuberance is a bulbous protuberance. Each possibility represents a separate embodiment of the present invention.

In another embodiment, the invention provides that the device such as footwear 10 supports the foot of a subject only by the two protuberances when the two protuberances are placed on a ground surface. In another embodiment, the invention provides that the device such as footwear 10 supports the foot of a subject during stance only by the two protuberances when the two protuberances are placed on a ground surface. In another embodiment, the invention provides that during stance only the 2 ground engaging surfaces of the protuberances (such as the peak or the surface facing the ground) are in contact with a ground surface. In another embodiment, the invention provides that during stance only the ground engaging surface in each protuberance is in contact with a ground surface. Each possibility represents a separate embodiment of the present invention.

In another embodiment, at least two bulbous protuberances 22 protrude from a lower surface 24 of support member 12. In another embodiment, only two bulbous protuberances 22 protrude from a lower surface 24 of support member 12. In another embodiment, a lower surface of support member is an outsole. In another embodiment, only two bulbous protuberances 22 protrude from a lower surface 24 of support member 12.

In another embodiment, the ground engaging parts of the device are only the protuberances. In another embodiment, during all phases of gait including the stance phase the protuberances are the only parts of the device which are ground engaging. In another embodiment, during all phases of gait including the stance phase the protuberances 22 are the only parts of the device which are in direct contact with the ground. Each possibility represents a separate embodiment of the present invention.

In another embodiment, a protuberance as described herein is movable. In another embodiment, a protuberance as described herein is fixable to a certain location on the sole. In another embodiment, a protuberance as described herein is mountable. In another embodiment, a protuberance as described herein is replaceable. In another embodiment, a protuberance as described herein is movable along the outer surface of the support member. In another embodiment, a protuberance as described herein is movable along the outer surface of the outsole. In another embodiment, a protuberance as described herein can be positioned within the outer surface of the support member. Each possibility represents a separate embodiment of the present invention.

In another embodiment, a protuberance as described herein is movable or translatable such as in a track (e.g., forwards, backwards, sideways or diagonally) and/or rotatable about its own or other axis, or a combination of such motions. Each possibility represents a separate embodiment of the present invention.

In another embodiment, a protuberance is movable within a predefined area. In another embodiment, a protuberance is movable within an area of 1 $cm^2$ to 18 $cm^2$. In another embodiment, a protuberance is movable within an area of 1 $cm^2$ to 6 $cm^2$. In another embodiment, a protuberance is movable within an area of 1 $cm^2$ to 4 $cm^2$. In another embodiment, a protuberance is movable within an area of 2 $cm^2$ to 8 $cm^2$. In another embodiment, a protuberance is movable within an area of 3 $cm^2$ to 6 $cm^2$. In another embodiment, a protuberance is movable within an area of 4 $cm^2$ to 10 $cm^2$. In another embodiment, a protuberance is movable within an area of 5 $cm^2$ to 18 $cm^2$. In another embodiment, a protuberance is movable within an area of 4 $cm^2$ to 12 $cm^2$. Each possibility represents a separate embodiment of the present invention.

In another embodiment, a predefined area is a circle. In another embodiment, a predefined area is a square. In another embodiment, a predefined area is an ellipse. In another embodiment, a predefined area is a rectangle. In another embodiment, a predefined area is quadrangular. In another embodiment, a predefined area comprises any shape known to one of skill in the art. In another embodiment, a predefined area is shapeless. Each possibility represents a separate embodiment of the present invention.

In another embodiment, a protuberance can be positioned anywhere on the support member. In another embodiment, a protuberance can be fixed anywhere on the support member. In another embodiment, a protuberance can be positioned and/or fixed anywhere within a predefined area. In another embodiment, the protuberance is hooked to a rail. In another embodiment, the protuberance is connected to a rail. In another embodiment, the protuberance is connected to a rail and is movable along the rail. In another embodiment, the protuberance is connected to a rail, is movable along the rail, and can be positioned and/or fixed anywhere along the rail. Each possibility represents a separate embodiment of the present invention.

In another embodiment, a protuberance is slidingly mounted on support member. In another embodiment, a protuberance is mounted on a track 36 (FIG. 2) formed in the lower surface 24 of support member 12, and is selectively positioned anywhere along the track and fastened and or fixed thereto. In another embodiment, track 36 extends along a portion of the shoe sole or all along the length of the shoe sole. Alternatively or additionally, the amount of protrusion of a protuberance is adjusted, such as by mounting protuberance with a threaded fastener 38 (FIG. 3) to support member 12 and tightening or releasing threaded fastener. In another embodiment, the term "fastening", "fixing" and "securing" are used interchangeably. Each possibility represents a separate embodiment of the present invention.

Figure 3:
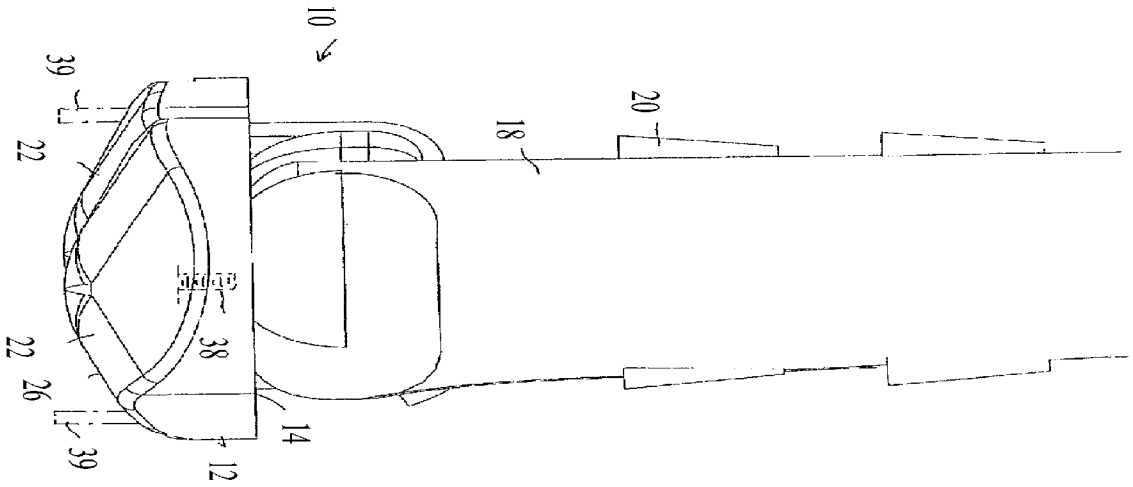

In another embodiment, a device as described herein further comprises an additional bulbous protuberance or bulbous protuberances, non-bulbous protuberance 39, or non-bulbous protuberances shown in FIG. 3. In another embodiment, protuberances 39 are formed in the shape of a peg, stud, bolt, pin, dowel and the like, although the invention is not limited to these shapes. In another embodiment, protuberances 39 may be rigid or flexible. In another embodiment, protuberances 39 are of different resilience or hardness, such as having different elasticity properties or Shore hardness. In another embodiment, protuberances 39 protrude by different amounts from the lower surface 24 of support member 12. In another embodiment, the amount of protrusion of protuberances 39 or height is adjusted. In another embodiment, protuberance 39 is fixed or movable at any place on the lower surface 24 of support member 12. Each possibility represents a separate embodiment of the present invention.

In another embodiment, a protuberance is slidingly mounted on support member 12. In another embodiment, a device such as footwear 10 comprises a sliding/shifting mechanism for a protuberance inside the sole of footwear 10. In another embodiment, the sliding/shifting mechanism comprises, without limitation, a mechanism that floats in a viscous matrix (e.g., fluid in a chamber formed in the sole), that is suspended by inner cables, or a niche trapping a protuberance with a fixing mean. Each possibility represents a separate embodiment of the present invention.

Fixing a BP

Figure 2:
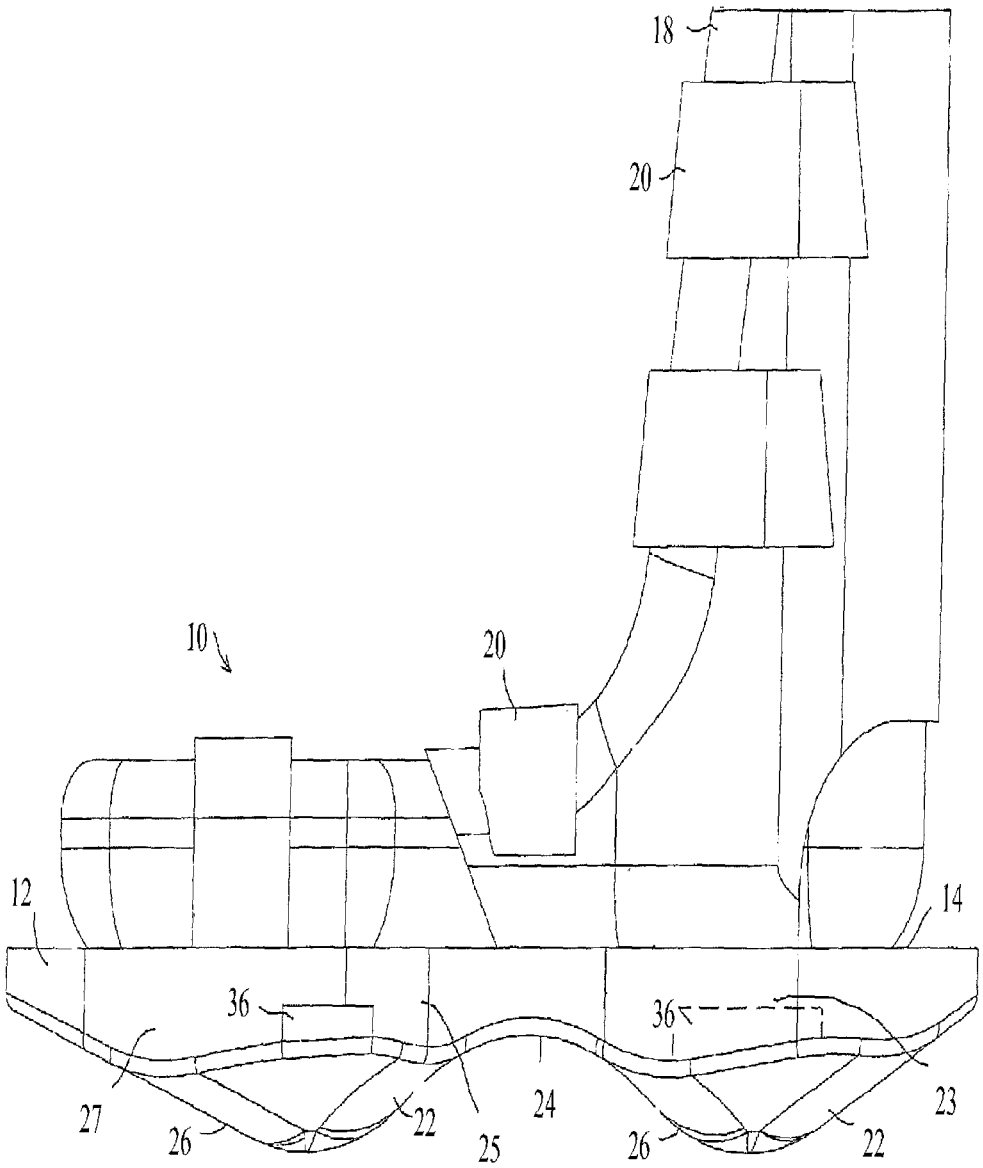
FIGS. 2 and 3 are simplified side-view and rear-view illustrations, respectively, of the footwear of FIG. 1.

As seen clearly in FIG. 2, one protuberance 22 may be positioned more posteriorly than the other protuberance 22. In another embodiment, a device as described herein comprises at least one anterior protuberance. In another embodiment, a device as described herein comprises at least one posterior protuberance. In another embodiment, the device consists one anterior protuberance and one posterior protuberance. In another embodiment, the device comprises at least one anterior protuberance and one moveable/relocatable posterior protuberance. In another embodiment, the device comprises at least one moveable/relocatable anterior protuberance and one posterior protuberance. In another embodiment, the device comprises at least one moveable/relocatable anterior protuberance and one moveable/relocatable posterior protuberance. In another embodiment, the device consists one moveable/relocatable anterior protuberance and one moveable/relocatable posterior protuberance. Each possibility represents a separate embodiment of the present invention.

In another embodiment, the protuberances rise vertically and therefore each protuberance comprises a base end and a peak end. In another embodiment, the surface area of the base is larger than the surface area of the peak. In another embodiment, the peak is the ground engaging portion of a protuberance in the stance phase. In another embodiment, the peak is the ground engaging portion of a protuberance in all gait phases. Each possibility represents a separate embodiment of the present invention.

In another embodiment, a protuberance such as a bulbous protuberance 22 protrudes from the upper surface 14 of support member 12.

Positions of BPs

Reference is now made, in one embodiment, to FIGS. 1-4, which illustrate footwear 10 constructed and operative in accordance with an embodiment of the present invention. Footwear 10, in one embodiment, is supplied as one or more pairs of shoe-like devices, or alternatively, as just one of the shoe-like devices. In another embodiment, a shoe-like device comprises a shoe platform and protuberances. Footwear 10, in one embodiment, is designed to adapt on a shoe such as Footwear 10. Footwear 10, in one embodiment, is a sandal or sandal-like footwear. In another embodiment, the shoe platform is a boot. In another embodiment, the shoe platform resembles a hiking boot. Each possibility represents a separate embodiment of the present invention. Each possibility represents a separate embodiment of the present invention.

In another embodiment, the footwear 10 comprises a support member 12 having a periphery in a shape of a shoe sole with an upper surface 14. In another embodiment, the footwear 10 comprises an insole placed on top of the upper surface 14. In another embodiment, the insole is the interior bottom of footwear 10. In another embodiment, the insole sits directly beneath the foot. In another embodiment, the insole is removable, replaceable, or both. In another embodiment, the insole adds comfort, control the shape, moisture, smell, or any combination thereof. In another embodiment, the insole is placed to correct defects in the natural shape of the foot or positioning of the foot during standing or walking. Each possibility represents a separate embodiment of the present invention.

In another embodiment, a support member 12 comprises an outsole. In another embodiment, a support member 12 comprises lower surface 24 or an outsole of support member 12. In another embodiment, lower surface 24 or an outsole is made of natural rubber or a synthetic imitation. In another embodiment, lower surface 24 or an outsole comprises a single piece, or may comprise separate pieces of different materials. In another embodiment, lower surface 24 or an outsole can be softer or harder. In another embodiment, a support member 12 further comprises a midsole which is a layer in between the outsole and the insole the most pressure down. In another embodiment, a support member 12 does not have a midsole. Each possibility represents a separate embodiment of the present invention.

In another embodiment, positioning at least a first bulbous protuberance and a second bulbous protuberance in a balanced position is the position in which the footwear exerts the least valgus, varus, dorsal or plantar torque about the ankle in a subject being examined. In another embodiment, positioning at least a first bulbous protuberance and a second bulbous protuberance in a balanced position is the position in which the footwear exerts a reduced or the least valgus, varus, dorsal or plantar torque about the ankle in a subject being examined. In another embodiment, positioning at least a first bulbous protuberance and a second bulbous protuberance in a balanced position is the position in which the footwear provides the least or minimal lower limbs muscle tonus. In another embodiment, positioning at least a first bulbous protuberance and a second bulbous protuberance in a balanced position is the position in which the footwear provides balanced lower limbs muscle tonus. In another embodiment, positioning at least a first bulbous protuberance and a second bulbous protuberance in a balanced position is toning lower limb muscles. In another embodiment, positioning at least a first bulbous protuberance and a second bulbous protuberance in a balanced position is toning the amount of tension or resistance to movement in a muscle involved in gait. In another embodiment, positioning at least a first bulbous protuberance and a second bulbous protuberance in a balanced position is lower limb unloading that allows maximal ankle, knee, and hip joint mobility. In another embodiment, positioning at least a first bulbous protuberance and a second bulbous protuberance in a balanced position is providing a reduction of muscle tone, larger passive ankle excursion, improved gait ability, or any combination thereof. In another embodiment, positioning at least a first bulbous protuberance and a second bulbous protuberance in a balanced position is increasing stride length, stance symmetry, or a combination thereof. In another embodiment, positioning at least a first bulbous protuberance and a second bulbous protuberance in a balanced position is increasing the length of the force point of action in lower limb muscles such as but not limited to: soleus, tibialis posterior, and both gastrocnemius muscles. In another embodiment, positioning at least a first bulbous protuberance and a second bulbous protuberance in a balanced position is toning the plantar flexors. In another embodiment, positioning at least a first bulbous protuberance and a second bulbous protuberance in a balanced position is preventing excessive forward rotation as the body moves forward over the stationary foot. In another embodiment, positioning at least a first bulbous protuberance and a second bulbous protuberance in a balanced position is toning the push off of the heel. Each possibility represents a separate embodiment of the present invention. Each possibility represents a separate embodiment of the present invention.

Figure 4:
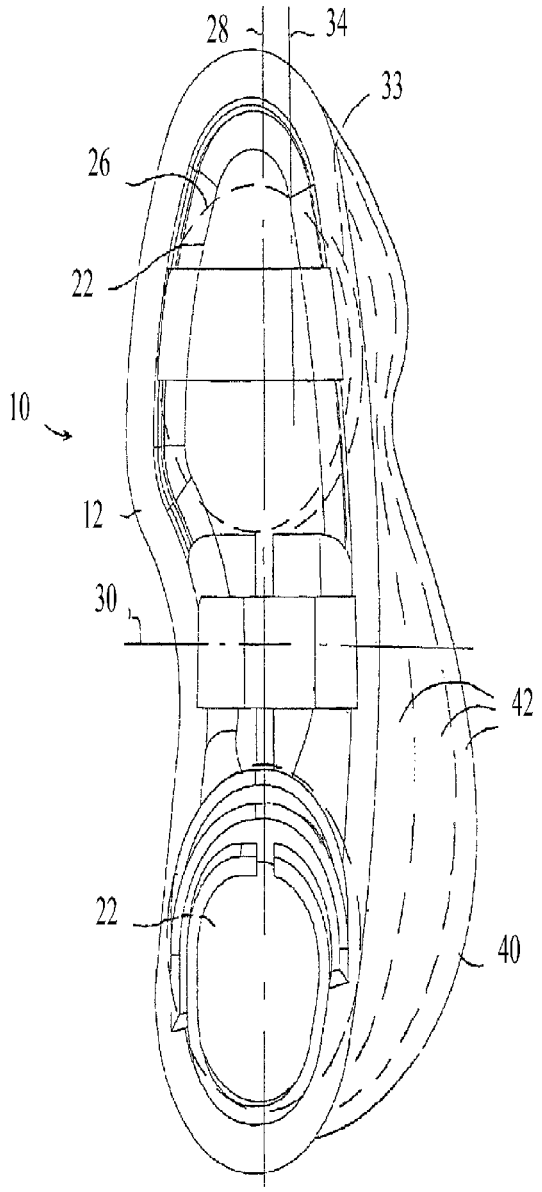
FIG. 4 is a simplified top-view illustration of the footwear of FIG. 1, showing further features of other embodiments of the present invention.

In another embodiment, as seen in FIG. 4, the protuberances are positioned on a common longitudinal axis of support member 12, such as the centerline 28 of support member 12. In another embodiment, the protuberances are positioned on opposite sides of the latitudinal midline 30. In another embodiment, the protuberances are positioned offset from the centerline 28 of support member 12, and on opposite sides of the latitudinal midline 30. In another embodiment, the bases of the protuberances are positioned on the centerline of the support member. In another embodiment, the peaks of the protuberances are positioned on opposite sides of the centerline of support member. Each possibility represents a separate embodiment of the present invention. In some embodiments, the meaning of "protuberance is positioned offset from the centerline" comprises that the peak or the ground engaging surface of a protuberances is positioned offset from the centerline. In some embodiments, the meaning of "protuberance is positioned offset from the centerline" comprises that only the peak or the ground engaging surface of a protuberances is positioned offset from the centerline but the centerline still crosses the protuberance.

In another embodiment, the peak or the ground engaging surface of the anterior protuberance is positioned laterally from the centerline of the support member. In another embodiment, the peak or the ground engaging surface engages the ground in an upright position. In another embodiment, the peak or the ground engaging surface of the anterior protuberance is positioned medially from the centerline of the support member. In another embodiment, the peak or the ground engaging surface of the anterior protuberance is positioned laterally from the centerline of the support member and the peak or the ground engaging surface of the posterior protuberance is aligned with centerline. In another embodiment, the peak or the ground engaging surface of the anterior protuberance is positioned medially from the centerline of the support member and the peak or the ground engaging surface of the posterior protuberance is aligned with centerline. Each possibility represents a separate embodiment of the present invention.

In another embodiment, the peak or the ground engaging surface of the posterior protuberance is positioned laterally from the centerline of the support member. In another embodiment, the peak or the ground engaging surface of the posterior protuberance is positioned medially from the centerline of the support member. In another embodiment, the peak or the ground engaging surface of the posterior protuberance is positioned laterally from the centerline of the support member and the peak or the ground engaging surface of the anterior protuberance is aligned with centerline. In another embodiment, the peak or the ground engaging surface of the posterior protuberance is positioned medially from the centerline of the support member and the peak or the ground engaging surface of the anterior protuberance is aligned with centerline. Each possibility represents a separate embodiment of the present invention.

In another embodiment, the peak or the ground engaging surface of the posterior protuberance is positioned laterally from the centerline of the support member and the peak or the ground engaging surface of the anterior protuberance is positioned medially from the centerline of the support member. In another embodiment, the peak or the ground engaging surface of the anterior protuberance is positioned laterally from the centerline of the support member and the peak or the ground engaging surface of the posterior protuberance is positioned medially from the centerline of the support member. Each possibility represents a separate embodiment of the present invention.

Figure 5:
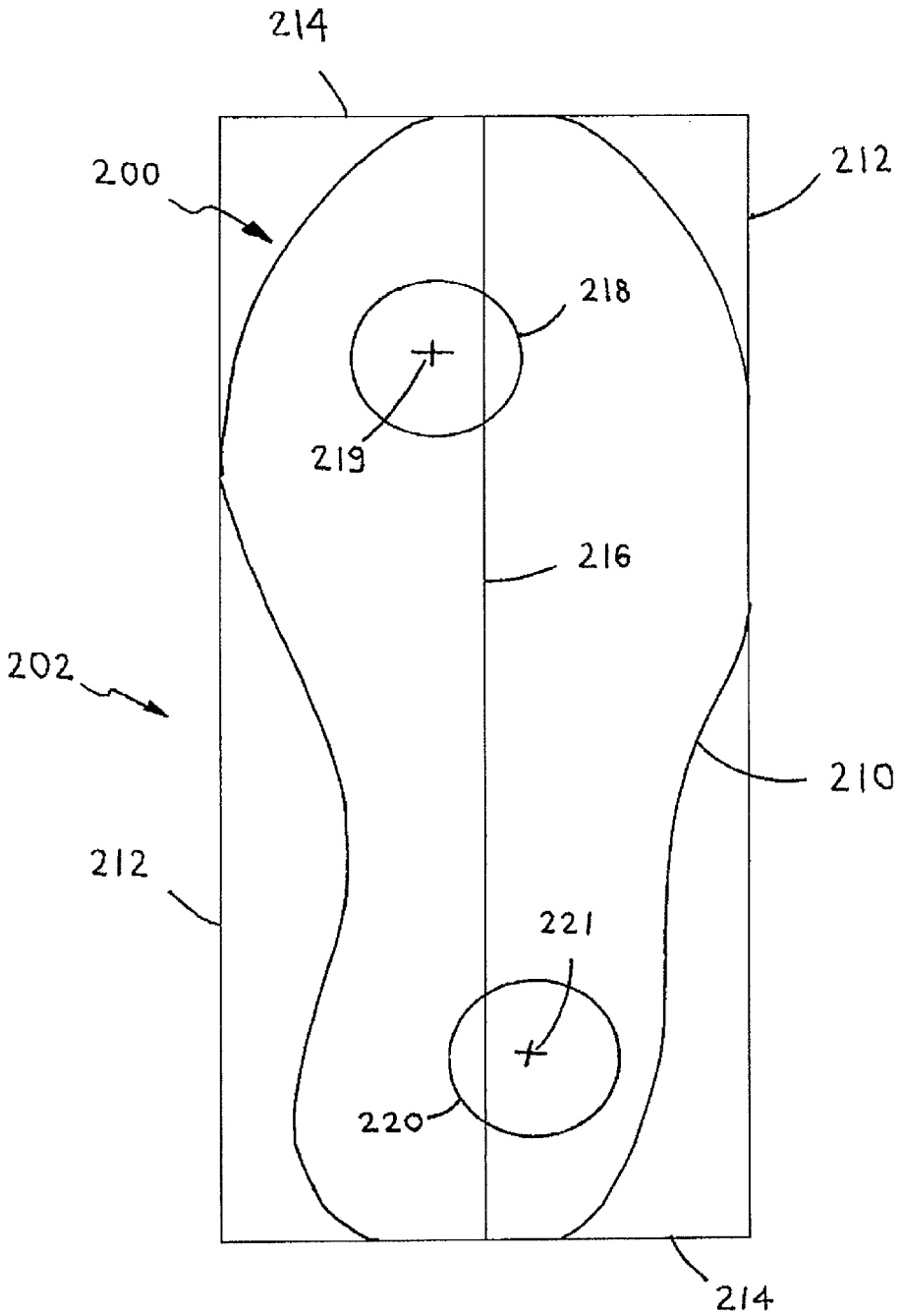
FIG. 5 is a simplified pictorial illustration of an alignment of the anterior (forward) and posterior (rearward) protuberances on a support member, according to embodiments of the present invention.
Figure 6:
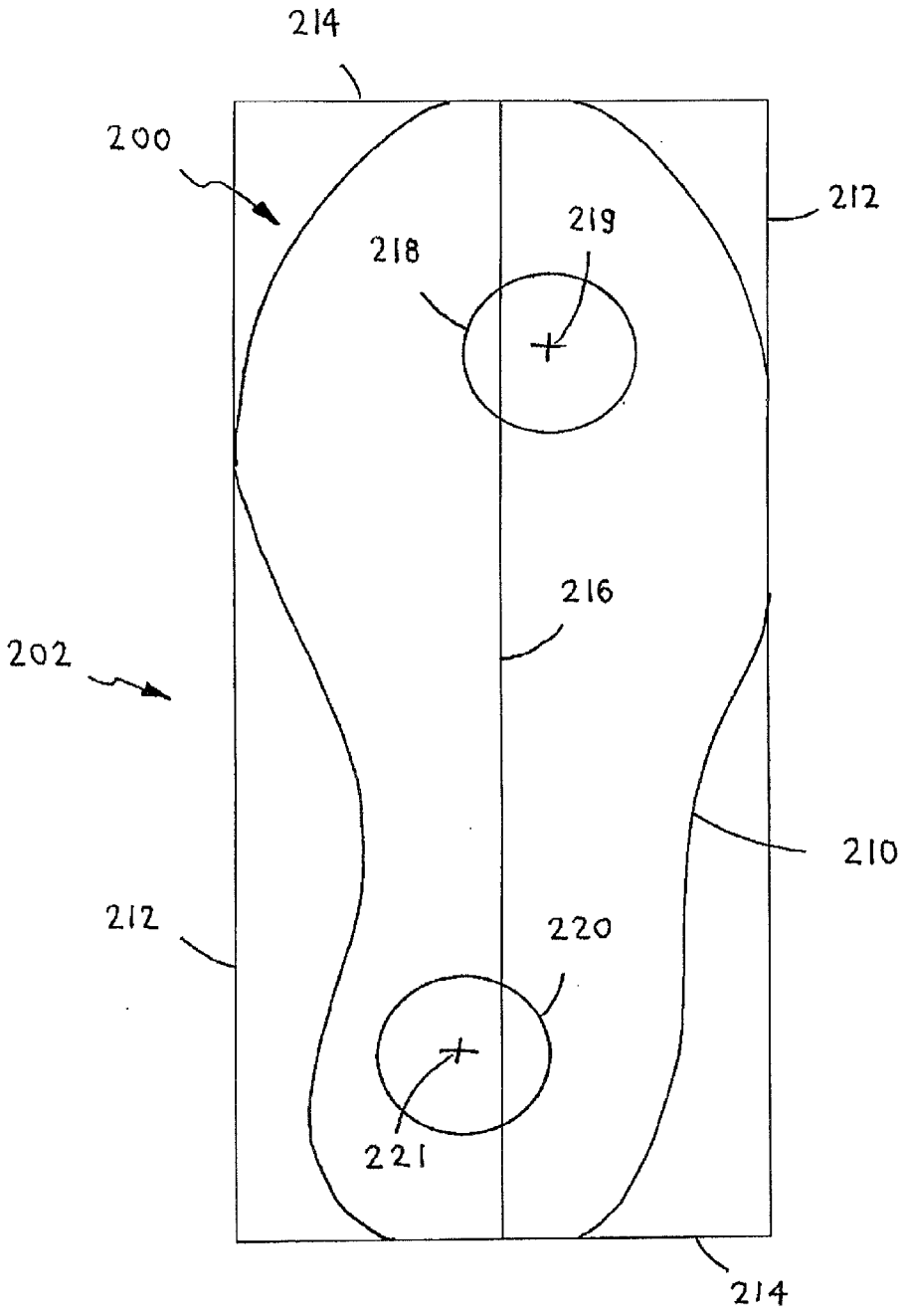
FIG. 6 is a simplified pictorial illustration of another alignment of the anterior and posterior protuberances on a support member, according to embodiments of the present invention.

In another embodiment, the centerline divides longitudinally the calcaneus support portion into two equal halves and further extends towards the phalanges and metatarsals support portion in a straight line. In another embodiment, the centerline divides longitudinally the arch of the calcaneus support portion into two equal halves and further extends towards the phalanges and metatarsals support portion in a straight line. In another embodiment, the centerline divides longitudinally the proximal arch of the calcaneus support portion into two equal halves and further extends towards the phalanges and metatarsals support portion in a straight line. In another embodiment, the centerline divides longitudinally the support portion as seen in FIGS. 5-6 of the calcaneus support portion into two equal halves and further extends towards the phalanges and metatarsals support portion in a straight line. In another embodiment of the present invention, the longitudinal centerline is defined as a longitudinal straight line connecting middles of the short sides of a rectangle which delimits a contour of the support member. Each possibility represents a separate embodiment of the present invention.

In another embodiment, the bases of the protuberances are positioned on the centerline of the support member and the peaks of the protuberances are positioned on opposite sides of the centerline of support member. In another embodiment, the bases of the protuberances are positioned on the centerline of the support member but the peaks of the protuberances are offset from the centerline of the support member. In another embodiment, the bases of the protuberances are positioned on the centerline of the support member but the peaks of the protuberances are positioned on opposite sides of the centerline of the support member. In another embodiment, positioning a protuberance is positioning the peak or the ground engaging surface of a protuberance. In another embodiment, the terms "peak" and "ground engaging surface" are used interchangeably. Each possibility represents a separate embodiment of the present invention.

In another embodiment, the anterior protuberance is positioned medially from the centerline of the support member. In another embodiment, the peak of the anterior protuberance is positioned medially from the centerline of the support member. In another embodiment, the base of the anterior protuberance is position on the centerline of the support member but the peak of the anterior protuberance is positioned medially from the centerline of the support member. In another embodiment, the anterior protuberance is positioned laterally from the centerline of the support member. In another embodiment, the peak of the anterior protuberance is positioned laterally from the centerline of the support member. In another embodiment, the base of the anterior protuberance is position on the centerline of the support member but the peak of the anterior protuberance is positioned laterally from the centerline of the support member. In another embodiment, the posterior protuberance is positioned medially from the centerline of the support member. In another embodiment, the peak of the posterior protuberance is positioned medially from the centerline of the support member. In another embodiment, the base of the posterior protuberance is position on the centerline of the support member but the peak of the posterior protuberance is positioned medially from the centerline of the support member. In another embodiment, the posterior protuberance is positioned laterally from the centerline of the support member. In another embodiment, the peak of the posterior protuberance is positioned laterally from the centerline of the support member. In another embodiment, the base of the posterior protuberance is position on the centerline of the support member but the peak of the posterior protuberance is positioned laterally from the centerline of the support member.

In another embodiment, as seen in FIG. 2, the posterior protuberance 22P is positioned generally underneath a calcaneus (heel, ankle) support portion 23 of support member 12. In another embodiment, the anterior protuberance 22A may be positioned generally underneath a metatarsals support portion 25 and/or phalanges support portion 27 of support member 12. Each possibility represents a separate embodiment of the present invention.

In another embodiment, as indicated by broken lines 33 in FIG. 4, the anterior protuberances 22A is aligned on a longitudinal axis with its peak offset from centerline 28, and the posterior protuberance 22P is also is aligned on a longitudinal axis with its peak offset from centerline 28 but to the opposite direction of 22A with respect to centerline 28. Each possibility represents a separate embodiment of the present invention.

In another embodiment, FIG. 5 is a simplified pictorial illustration of an alignment of the anterior (forward) and posterior (rearward) protuberances on a support member 200, according to embodiments of the present invention. Centerline 216, in the embodiment is defined as a longitudinal straight line (median) that connects the middles of short sides 214 of a rectangle 212, the long sides 212 of which are parallel to centerline 216, and which delimits the contour 210 of the support member. In embodiments of the present invention contour 210 is the contour (254, see FIG. 7) of the foothold confined by the upper part (253, see FIG. 7) of the footwear (250, see FIG. 7), corresponding to the last which is used to form the footwear. In other embodiments of the present invention contour 210 is the outermost contour of the footwear. In other embodiments of the present invention contour 210 is the contour of the bottom surface of the sole of the footwear. In some embodiments, the terms "forward" and "anterior" are used interchangeably. In some embodiments, the terms "rearward" and "posterior" are used interchangeably. Each possibility represents a separate embodiment of the present invention.

According to embodiments of the present invention, as shown in FIG. 5, forward protuberance 218 at the anterior (phalanges) portion of the support member (i.e. its front portion) is positioned medially offset to centerline 216. By "medially offset" is meant that a peak surface (which can be the ground engaging surface) of protuberance 218 (marked by cross 219) is shifted from centerline 216 medially towards the inner side of support surface 200, facing the support member of the other foot (not shown in this figure). The peak surface is a surface on the protuberance which is furthest from the support surface with respect to other surfaces of the protuberance. Each possibility represents a separate embodiment of the present invention.

According to embodiments of the present invention, as shown in FIG. 5, rearward (posterior) protuberance 220 at the posterior (calcaneus) portion of the support member (i.e. its back portion) is positioned laterally offset to centerline 216. By "laterally offset" is meant that a peak surface (which can be the ground engaging surface) of protuberance 220 (marked by cross 221) is shifted from centerline 216 laterally towards the outer side of support surface 200, away from the support member of the other foot (not shown in this figure). Each possibility represents a separate embodiment of the present invention.

The alignment of the protuberances shown in FIG. 5 is useful, for example, for tuning muscles for users suffering from one or more of the following medical indications: medical compartment-knee osteoarthritis medical meniscus tear or damage, genu varus, patello-femoral pain syd, patello-femoral problem (malalignment), lateral collateral ligamental damage or tear, bone bruise MTP/MFC (AVN), low back pain or spine pathology, hip OA, hip labrum damage (TCM), trochanteric bursitis, pes anseninus bursitis, ankle instability (supination and ext rut), achilles tendonitis and metatrsalgia. Each possibility represents a separate embodiment of the present invention.

FIG. 6 is a simplified pictorial illustration of another alignment of the anterior and posterior protuberances on a support member, according to embodiments of the present invention. According to embodiments of the present invention, as shown in FIG. 6, forward (anterior) protuberance 218 is laterally offset to centerline 216, whereas rearward protuberance 220 is medially offset to centerline 216. The alignment of the protuberances shown in FIG. 5 is useful, for example, for tuning muscles for users with one or more of the following medical indications: lateral meniscus tear or damage, lateral compartment knee osteoarthritis, valgus knee (genu valgus), patello-femoral pain syal, patello-femoral problem (malalignment), MCL Ligament tear, bone bruise LTP/LFC (AVN), hip labrum damage or tear, hip pain, ankle instability (pronoation), achilles tendonitis, tibilias insufficiency and metatansalgia. Each possibility represents a separate embodiment of the present invention.

Figure 7:
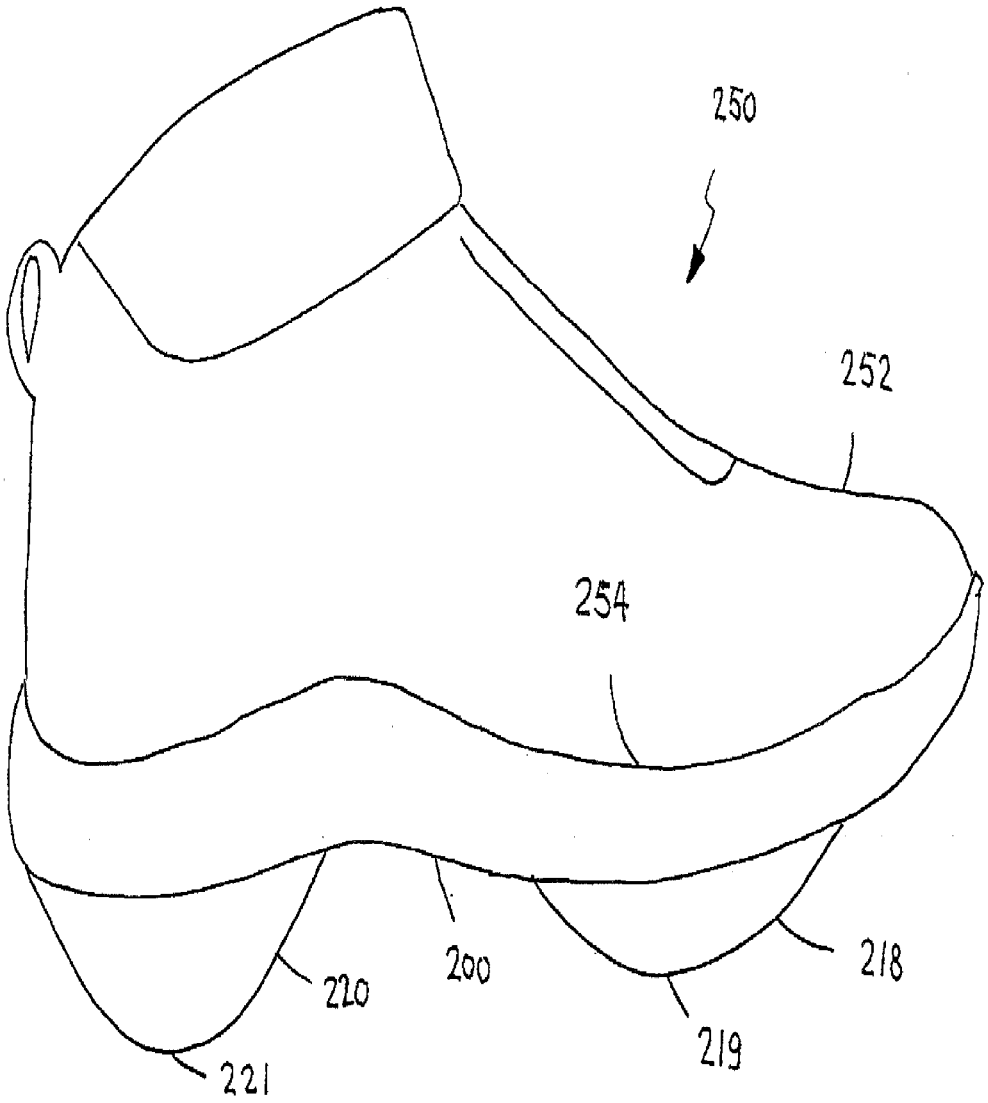
FIG. 7 is a simplified pictorial illustration of a sneaker constructed and operative in accordance with an embodiment of the present invention, whose rearward protuberance has a greater height than the height of the forward protuberance.

FIG. 7 is a simplified pictorial illustration of a sneaker 250 constructed and operative in accordance with an embodiment of the present invention, whose rearward protuberance 220 has a greater height (protrusion) than the height of the forward protuberance 218. It is noticeable that such arrangement facilitates initial contact between rearward protuberance 220 and the supporting ground (not shown in this figure) when a user wears the sneaker, before the forward protuberance is brought in contact with the ground. When both protuberances are placed in contact with the ground the foot of the user wearing sneaker 250 acquires a downward inclination with respect to direction of gait of the user. Each possibility represents a separate embodiment of the present invention.

Figure 8:
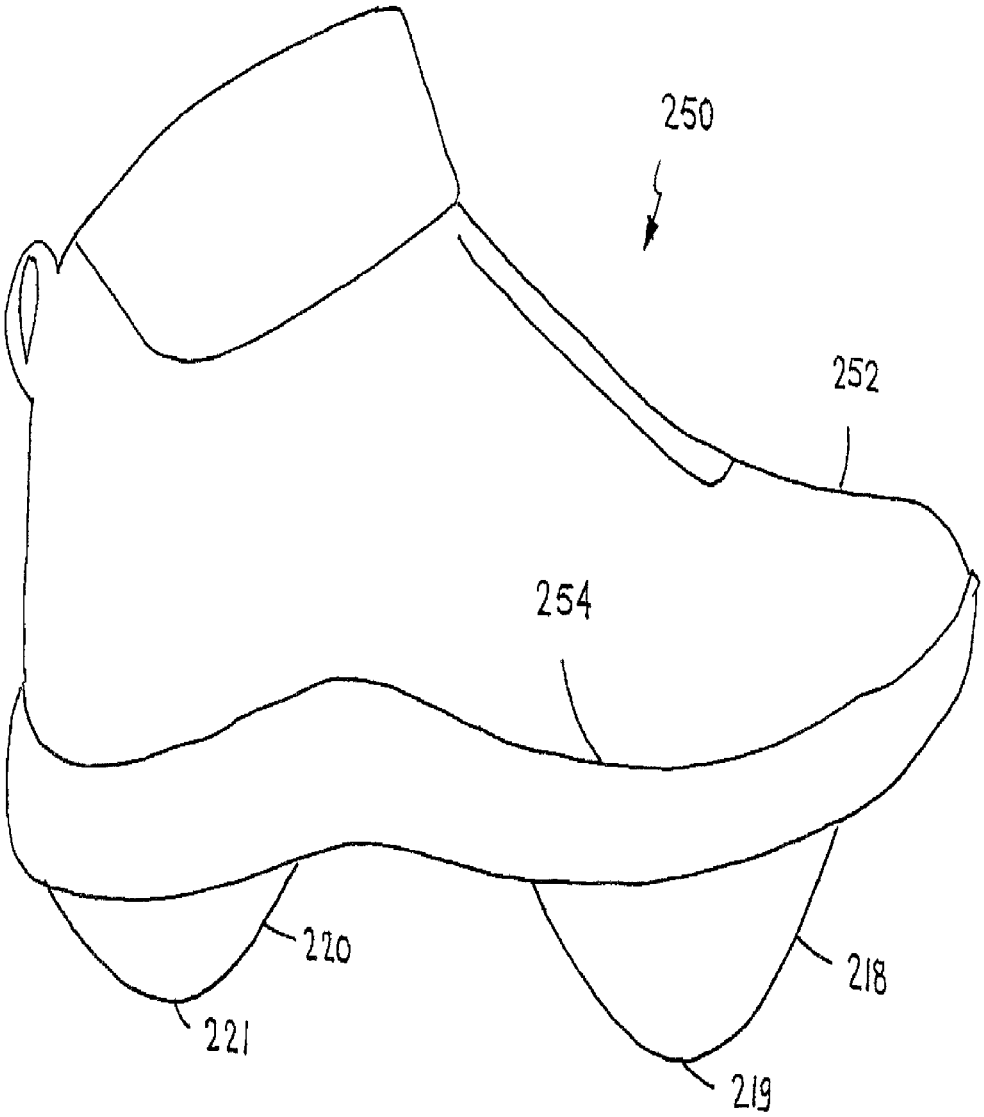
FIG. 8 is a simplified pictorial illustration of a sneaker constructed and operative in accordance with an embodiment of the present invention, whose forward protuberance has a greater height than the height of the rearward protuberance.

FIG. 8 is a simplified pictorial illustration of a sneaker 250 constructed and operative in accordance with an embodiment of the present invention, whose forward protuberance 218 has a greater height than the height of the rearward protuberance 220. In this embodiment when both protuberances are placed in contact with the ground the foot of the user wearing sneaker 250 acquires an upward inclination (with respect to the direction of gait of the user. Each possibility represents a separate embodiment of the present invention.

Figure 9:
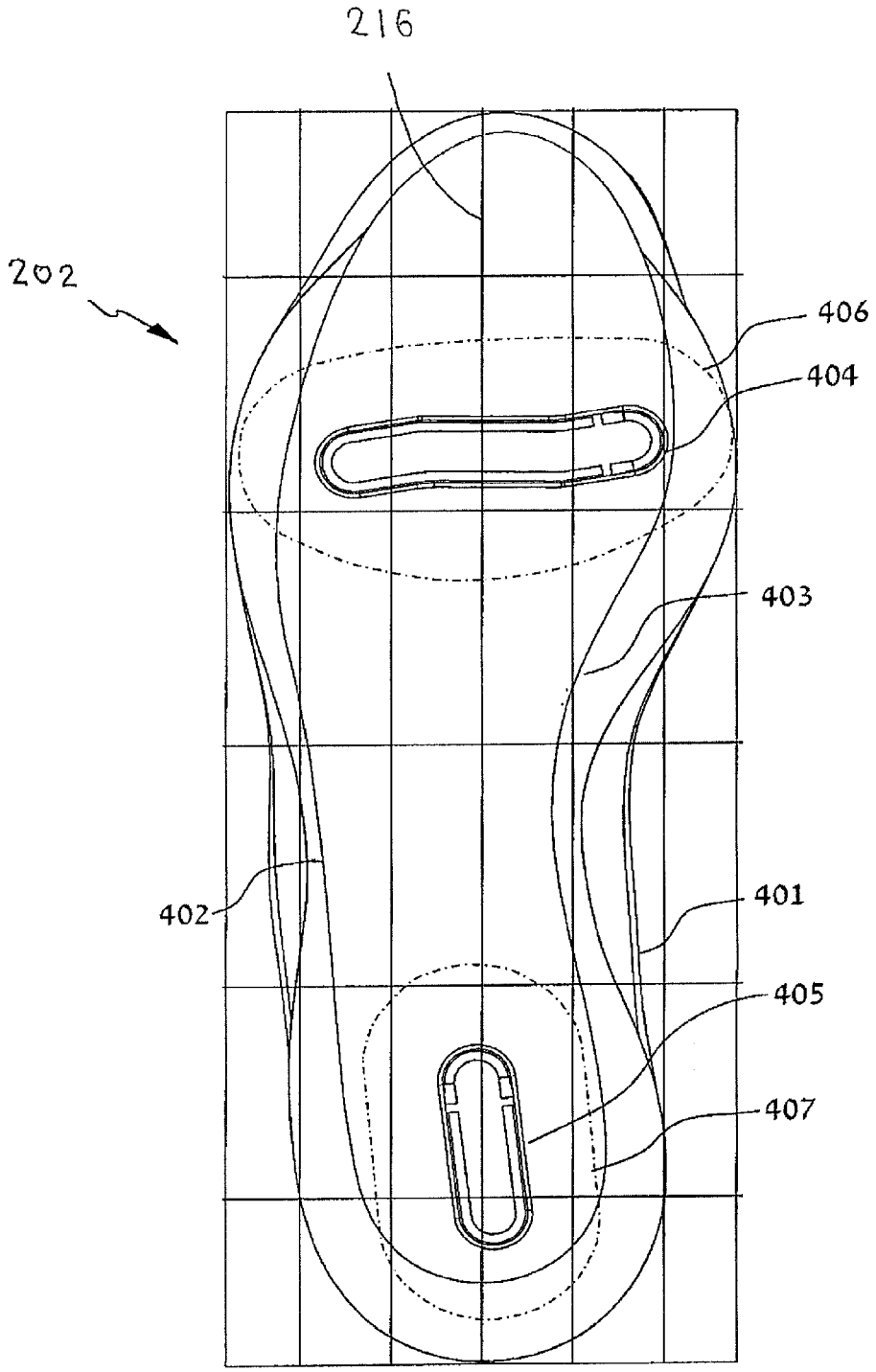
FIG. 9 illustrates maximal area boundaries of positioning of the anterior and posterior protuberances with respect to a support surface, according to embodiments of the present invention.

FIG. 9 illustrates maximal area boundaries of positioning of the anterior and posterior protuberances with respect to a support surface, according to embodiments of the present invention. Shown in this figure is a bottom view of a sneaker designed to be worn on a right foot of a user. The medial side is thus the right side of the drawing, facing the arc of greater curvature of the side arcs of the sneaker. The lateral side is opposite to the medial side that is the left side of the drawing, facing the arc of lesser curvature of the side arcs of the sneaker. Indicated are the midsole 401 and last/shoe 402, contour 403 of the foothold which is determined by the last used in the making of the sneaker. Front rail 404 and rear rail 405 are used for anchoring the protuberance. The area bordered by dotted line 406 marks the maximal area within which the peak surface of the anterior protuberance, i.e. the ground engaging surface of the anterior protuberance, may be located, according to some embodiments of the present invention. The area bordered by dotted line 407 marks the maximal area within which the peak surface of the posterior protuberance. Each possibility represents a separate embodiment of the present invention.

Figure 10:
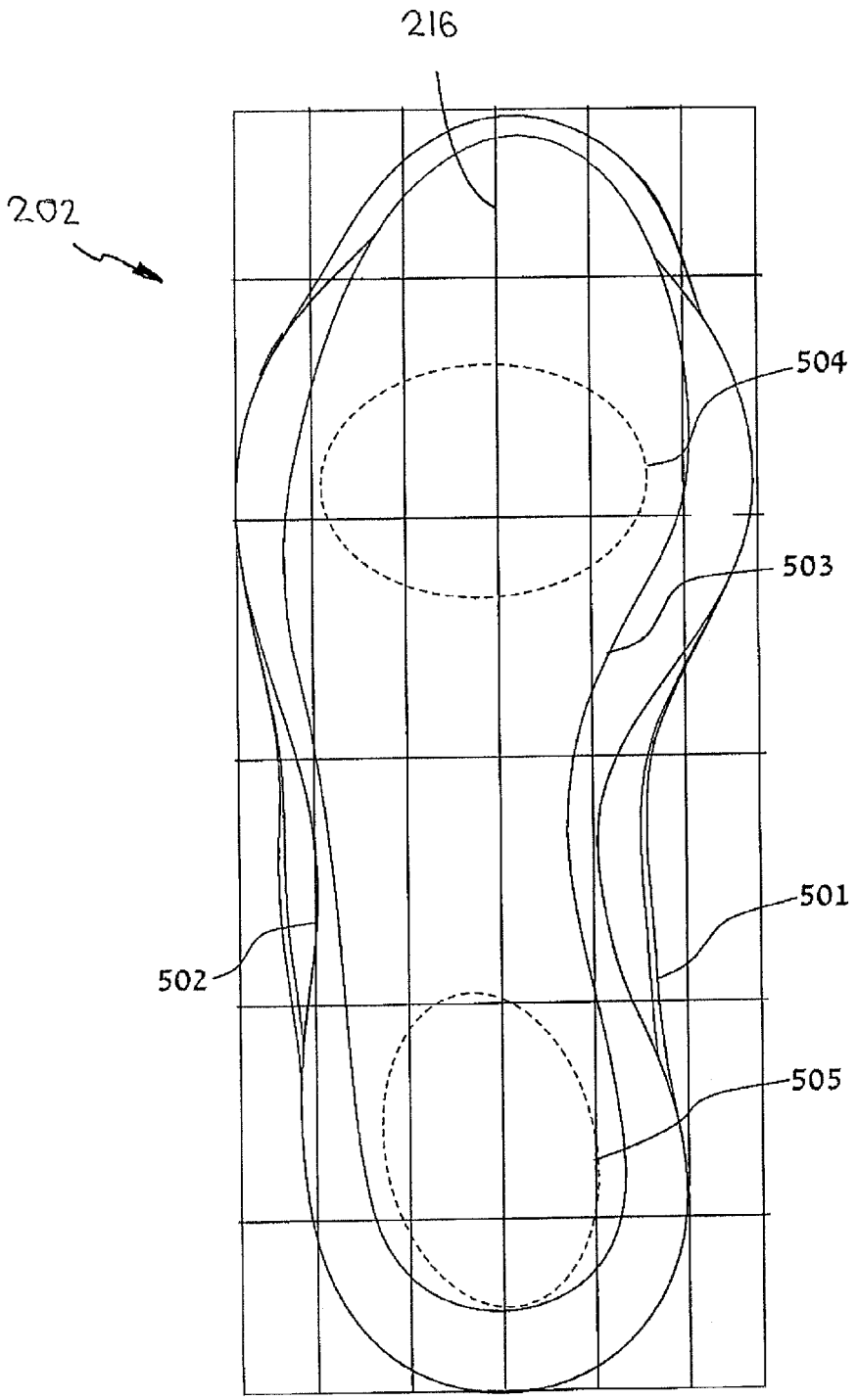
FIG. 10 illustrates effective area boundaries of positioning of the anterior and posterior protuberances with respect to a support surface, according to embodiments of the present invention.

FIG. 10 illustrates the effective area boundaries of positioning of the anterior and posterior protuberances with respect to a support surface, according to embodiments of the present invention. Indicated are the midsole 501 and outsole 502, contour 503 of the foothold which is determined by the last used in the making of the sneaker. The area bordered by dotted line 504 marks the effective area within which the peak surface of the anterior protuberance, i.e. the ground engaging surface of the anterior protuberance, may be located, according to some embodiments of the present invention. The area bordered by dotted line 505 marks the effective area within which the peak surface of the posterior protuberance. "Effective" refers to the effectiveness of use of the footwear according to embodiments of the present invention, which facilitates treatment. For clarity both FIGS. 9 and 10 are divided to 36 equal parts. The effective locations will be within the same parts regardless of sizing. Each possibility represents a separate embodiment of the present invention.

Figure 11:
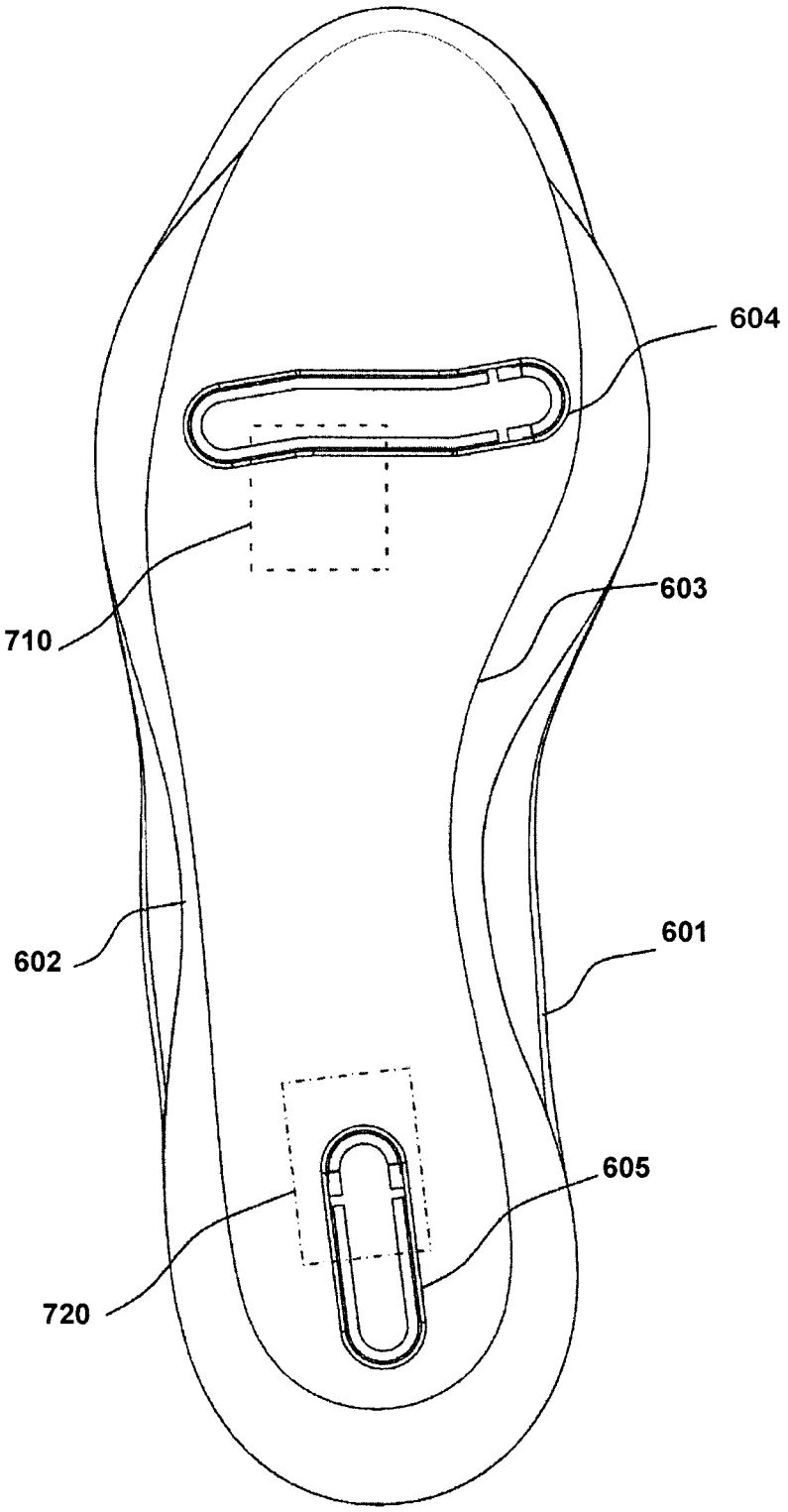
FIG. 11 illustrates the rails and certain area boundries of positioning of the anterior and posterior protuberances with respect to a support surface, according to embodiments of the present invention.

FIG. 11 illustrates the effective area boundaries of positioning of the anterior and posterior protuberances with respect to a support surface, according to embodiments of the present invention which include treatment and/or improvement of function and/or alleviation of pain for a subject which is at high risk of falls. Indicated is the area bordered by dotted line 710 which marks the effective area within which the peak surface of the anterior protuberance, i.e. the ground engaging surface of the anterior protuberance, may be located, while treating or alleviating pain for the diseases and/or conditions described for FIG. 11 hereinabove. Indicated is the area bordered by dotted line 720 which marks the effective area within which the peak surface of the posterior protuberance, i.e. the ground engaging surface of the posterior protuberance, may be located, while treating or improving function or alleviating pain for the diseases and/or conditions described for FIG. 11 hereinabove. The areas bordered by dotted lines 710 and 720 are within the areas bordered by dotted lines 504 and 505, respectively, in FIG. 10. As provided before, FIG. 10 is divided to 36 equal parts. The effective locations will be within these effective parts regardless of sizing. Each possibility represents a separate embodiment of the present invention.

Figure 12:
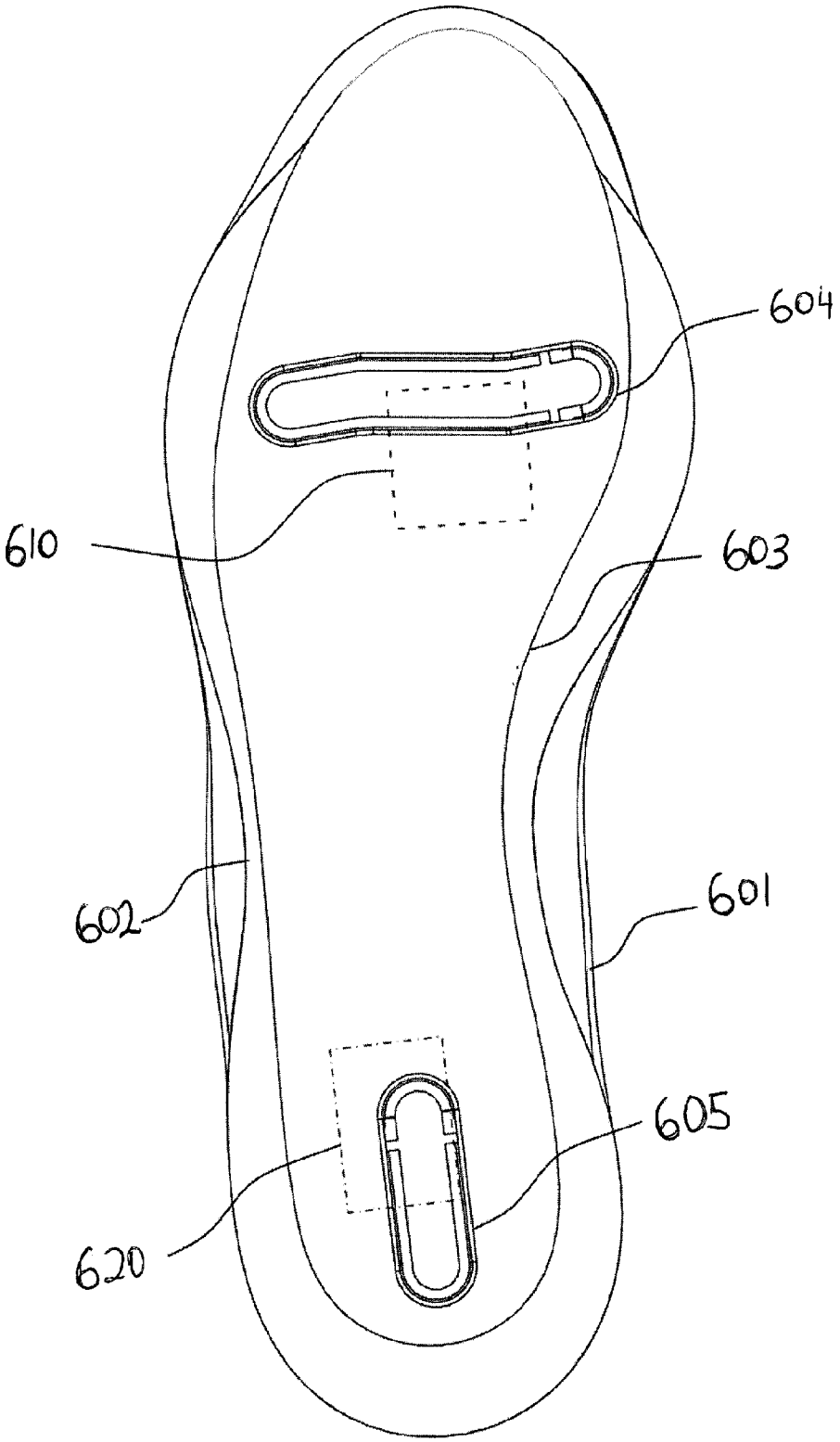
FIG. 12 illustrates the rails and certain area boundries of positioning of the anterior and posterior protuberances with respect to a support surface, according to embodiments of the present invention.

FIG. 12 illustrates the effective area boundaries of positioning of the anterior and posterior protuberances with respect to a support surface, according to embodiments of the present invention which include treatment and/or improvement of function and/or alleviation of pain of a subject which is at high risk of falls. Indicated are the midsole 601 and outsole 602, last 603 of the foothold which is determined by the last used in the making of the sneaker. Front rail 604 and rear rail 605 are used for anchoring the protuberance. Indicated is the area bordered by dotted line 610 which marks the effective area within which the peak surface of the anterior protuberance, i.e. the ground engaging surface of the anterior protuberance, may be located, while treating or alleviating pain for the diseases and/or conditions described for FIG. 12 hereinabove. Indicated is the area bordered by dotted line 620 which marks the effective area within which the peak surface of the posterior protuberance, i.e. the ground engaging surface of the posterior protuberance, may be located, while treating or improving function or alleviating pain for the diseases and/or conditions described for FIG. 12 hereinabove. The areas bordered by dotted lines 610 and 620 are within the areas bordered by dotted lines 504 and 505, respectively, in FIG. 10. As provided before, FIG. 10 is divided to 36 equal parts. The effective locations will be within these effective parts regardless of sizing. Each possibility represents a separate embodiment of the present invention.

Figure 13A:
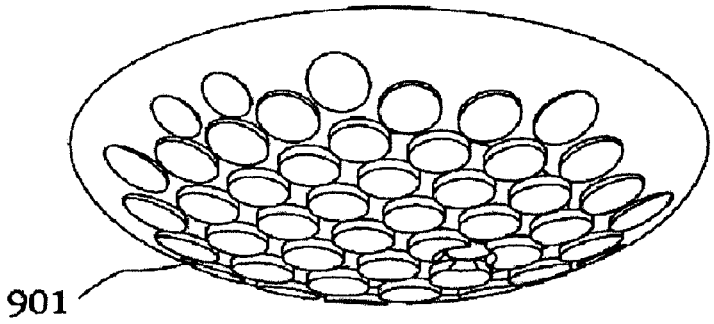
FIG. 13A is an isometric view of a protuberance suitable for use on a footwear, according to embodiments of the present invention.
Figure 13B:
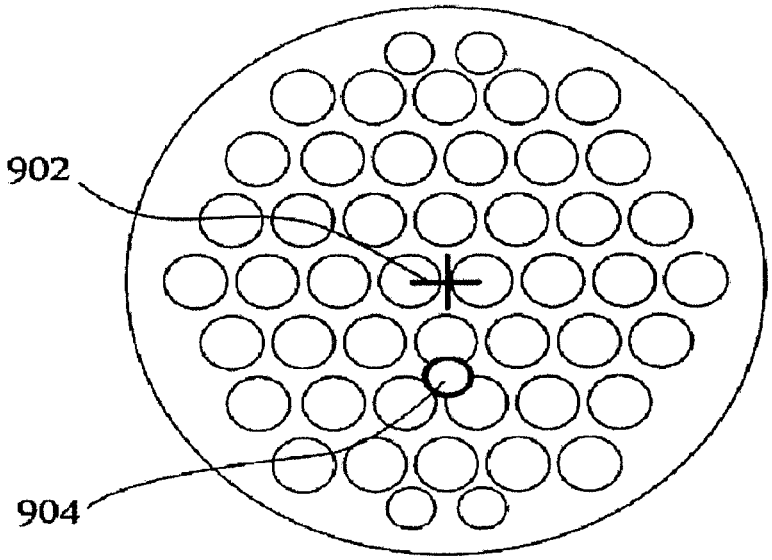
FIG. 13B is a frontal view of a protuberance suitable for use on a footwear, according to embodiments of the present invention.
Figure 13C:
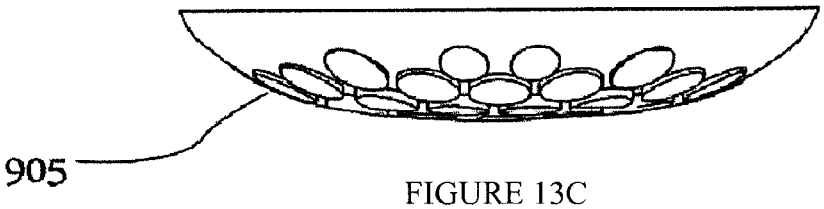
FIG. 13C is a side view of a protuberance suitable for use on a footwear, according to embodiments of the present invention.

FIG. 13A is an isometric view of a protuberance suitable for use on a footwear, according to embodiments of the present invention. Cleats 901, according to embodiments of the present invention, cover the ground engaging area of a protuberance, for facilitating enhanced grip of the surface on which the user stands or walks. FIG. 13B is a frontal view of a protuberance suitable for use on a footwear, according to embodiments of the present invention. The peak surface is marked by cross 902. Bore 904 is provided for a screw or other fastening arrangement to fix the protuberance in the desired position. FIG. 13C is a side view of a protuberance suitable for use on a footwear, according to embodiments of the present invention. Convexity 905 of the protuberance is clearly seen. Various convexities may be employed, all of which define a peak surface, typically (but not necessarily) at the center of the protuberance, which is the surface which comes in contact with the ground, when the user attaches the support member to the foot, and walks or stands on the ground.

FIG. 13 is a simplified pictorial illustration of a protuberance according to embodiments of the present invention. As shown a protuberance is convex 905 (FIG. 13C). Each protuberance, according to embodiments of the present invention, comprises a fixing hole (for fixing a protuberance) 904 in which a latch, a bolt, or a screw is placed therein. The peak of a protuberance, which in some embodiments of the present invention, is placed within the center of the ground engaging area 902 is in contact with the ground during stance (FIG. 13B).

Resilience, Hardness, and Elasticity

In another embodiment, calibrating comprises positioning a protuberance on a support member. In another embodiment, calibrating comprises adjusting the height (or the extent of protrusion) of a protuberance. In another embodiment, calibrating comprises adjusting a resilience of a protuberance. In another embodiment, calibrating comprises adjusting a hardness of a protuberance. In another embodiment, calibrating comprises adjusting an elasticity of a protuberance. Each possibility represents a separate embodiment of the present invention.

In another embodiment, a protuberance is compressible. In another embodiment, a protuberance is deformable. In another embodiment, a protuberance is compressible or deformable upon pressure exerted by subject's weight. Each possibility represents a separate embodiment of the present invention.

In another embodiment, a protuberances is constructed of any suitable material, such as but not limited to, elastomers or metal or a combination of materials, and have different properties. In another embodiment, a protuberance comprises different resilience or hardness, such as having different elasticity properties or Shore hardness. Each possibility represents a separate embodiment of the present invention.

In another embodiment, a protuberance comprises spikes or grip means for providing better stability. In another embodiment, a protuberance comprises spikes or grip means as anti-slippery means. In another embodiment, FIG. 13 provides a protuberance comprising small rounded grip means. In another embodiment, spikes or grip means are constructed of any suitable material, such as but not limited to: elastomers such as rubbers or plastic materials. In another embodiment, spikes or grip means cover only a portion of a protuberance. In another embodiment, spikes or grip means cover at least a ground engaging surface of a protuberance (the surface in contact with the ground during stance). In another embodiment, a fixing means for securing a protuberance to the support portion is embedded within a spikes or a grip means. In another embodiment, a fixing means for securing a protuberance to the support portion is places in between spikes or a grip means. Each possibility represents a separate embodiment of the present invention.

In another embodiment, a protuberance has a shore hardness of between 30 to 90 Sh A. In another embodiment, a protuberance has a shore hardness of between 40 to 55 Sh A. In another embodiment, a protuberance has a shore hardness of between 50 to 70 Sh A. In another embodiment, a protuberance has a shore hardness of between 65 to 90 Sh A. In another embodiment, a protuberance has a shore hardness of between 55 to 60 Sh A. In another embodiment, a protuberance has a shore hardness of between 65 to 70 Sh A. In another embodiment, an anterior and a posterior protuberance comprise identical shore hardness. In another embodiment, an anterior and a posterior protuberance comprise different shore hardness. Each possibility represents a separate embodiment of the present invention.

In another embodiment, a protuberance is a soft protuberance comprising a shore hardness of between 40 to 55 Sh A. In another embodiment, a protuberance is a medium hardness protuberance comprising a shore hardness of between 50 to 70 Sh A. In another embodiment, a protuberance is a hard protuberance comprising a shore hardness of between 65 to 90 Sh A.

In another embodiment, a protuberance has an abrasion between 1-60 $mm^3$ (by DIN 53516). In another embodiment, a protuberance comprises a rubber cup. In another embodiment, a protuberance comprises natural rubber compounds. In another embodiment, a protuberance comprises synthetic rubber compounds such as TPU or TPR. In another embodiment, a protuberance comprises silicone. In another embodiment, a protuberance a plastic material such as PA 6 (nylon), PA6/6 (nylon)+glass fiber, ABS, Polypropylene, POM (Polyoxymethylene). In another embodiment, a protuberance comprises a metal such as aluminum, steel, stainless steel, brass, or metal alloys. In another embodiment, a protuberance comprises compound materials such as glass fibers, carbon fibers, kevlar, or any combination thereof. Each possibility represents a separate embodiment of the present invention.

Adjustments

In another embodiment, a protuberance has a base diameter of at least 35 mm. In another embodiment, a protuberance has a base diameter of at least 45 mm. In another embodiment, a protuberance has a base diameter of at least 55 mm. In another embodiment, a protuberance has a base diameter of at least 65 mm. In another embodiment, a protuberance has a base diameter of at least 75 mm. In another embodiment, a protuberance has a base diameter of at least 85 mm. In another embodiment, a protuberance has a base diameter of 35 to 95 mm. In another embodiment, a protuberance has a base diameter of 45 to 105 mm. In another embodiment, a protuberance has a base diameter of 45 to 95 mm. In another embodiment, a protuberance has a base diameter of 55 to 95 mm. In another embodiment, a wider base diameter is used to further stimulate weight bearing. In another embodiment, the flexibility in choosing different base diameters allows balancing a patient suffering from imbalance by stimulating differential weight bearing.

In another embodiment, different heights of a protuberance can be used. In another embodiment, a height of a protuberance is correlative or equal to the amount of protrusion. In another embodiment, the amount of protrusion is the distance from the surface of the support member to the ground engaging portion of a protuberance. In another embodiment, the amount of protrusion is the distance from the surface of the support member to the most distant ground engaging portion of a protuberance. In another embodiment, height is calibrated by adding a spacer between a protuberance and the outsole. In another embodiment, different weights of a protuberance can be used. In another embodiment, weight is calibrated by adding a spacer between a protuberance and the outsole.

In another embodiment, the height of the anterior protuberance differs from the height of the posterior protuberance. In another embodiment, the height of the anterior protuberance or of the posterior protuberance is adjusted with round spacers positioned between the support member or the outsole and the base portion of a protuberance. In another embodiment, a spacer (for inducing further protrusion) is fixed between the outsole and base portion of a protuberance. In another embodiment, muscular control around the pelvis in a scoliosis patient is induced by utilizing two weighted spacers secured to the right and the left posterior BPs. In another embodiment, muscular control around the pelvis in a scoliosis patient is induced by utilizing two weighted spacers (disc), 3 mm high and 100 gr. in weight, secured to the right and the left posterior BPs. Each possibility represents a separate embodiment of the present invention.

In another embodiment, a spacer or a protuberance comprises a diameter of 50-150 mm. In another embodiment, a spacer or a protuberance comprises a diameter of 55-110 mm. In another embodiment, a spacer or a protuberance comprises a diameter of 60-100 mm. In another embodiment, a spacer or a protuberance comprises a diameter of 80-90 mm. In another embodiment, a spacer or a protuberance comprises a diameter of 85 mm. In another embodiment, a spacer or a protuberance or a protuberance comprises a thickness of 1-12 mm. In another embodiment, a spacer or a protuberance comprises a thickness of 1-4 mm. In another embodiment, a spacer or a protuberance comprises a thickness of 3-10 mm. In another embodiment, a spacer or a protuberance comprises a thickness of 1-3 mm. In another embodiment, a spacer or a protuberance comprises hardness of 60-70 Shore A, which is a soft spacer. In another embodiment, a spacer or a protuberance comprises hardness of 90-100 Shore A, which is a hard spacer. In another embodiment, a spacer or a protuberance comprises hardness of 71-89 Shore A, which is medium hardness spacer.

In another embodiment, a spacer or a protuberance weighs 2-500 g. In another embodiment, a spacer or a protuberance weighs 2-250 g. In another embodiment, a spacer or a protuberance weighs 2-6 g. In another embodiment, a spacer or a protuberance weighs 2-20 g. In another embodiment, a spacer or a protuberance weighs 2-20 g is made of Nylon. In another embodiment, a spacer or a protuberance weighs 2-20 g is made of Nylon and fiber. In another embodiment, a spacer or a protuberance weighs 2-40 g is made of Nylon and glass fiber. In another embodiment, a spacer or a protuberance weighs 30-100 g. In another embodiment, a spacer or a protuberance weighs 50-80 g. In another embodiment, a spacer or a protuberance weighs 60-100 g. In another embodiment, a spacer or a protuberance comprises: Nylon glass fiber polyurethane an alloy (such as but not limited to Zink alloy), or any combination thereof. Each possibility represents a separate embodiment of the present invention.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Materials and Methods

Pain Evaluation

In all case studies, pain is presented as graded by the patient on a 10 cm Visual analogue scale (VAS). The ends of the scale were defined as 0—no pain and 10—worst pain imaginable. A pain of 4/10 means 4 cm out of 10 cm.

Positioning Method

After each change (calibration, positioning) in the configuration of the protuberances attached to the footwear, the patient was asked to walk a distance of 20 meters in order to verify that the patient remains balanced and that the change in configuration resulted in a desired effect.

Prescribing the Device

The device comprises 2 units of footwear: one for the left foot and one to the right foot. The footwear used is a light walking boot.

Prescription includes a set of instructions to the patients. These instructions included: duration of wearing the device per day (usually 30-60 minutes daily). Daily use included wearing the device during routine activities that may include watching TV, computer activities; eating activities, etc. Actual walking constituted 10-25% of 30-60 minutes. Thus, if patient wore the device for 60 minutes per day, total of 5-10 minutes were dedicated, accumulatively, to walking.

Gait Measurements

Gait measurements include spatio-temporal measurements performed by various computerized mats as well as three-dimensional gait labs or other gait lab that are able to measure velocity, step length and single limb support. Unless noted otherwise, the gait lab is done when patient is barefoot.

In the studies below, physiological values of Single Limb Support are between 38%-40% of the step cycle. In some pathologies (e.g. reduced sensory input, central or neurological pain, and the like), the single limb support is usually lower than 40% and sometimes lower than 38%. In other pathologies (e.g. hyper-mobility of the joints and/or poor proximal (pelvic) control) single limb support is usually higher than 40%.

In the "pain" section of the calibrations a repeated shift is described in order to bring the patient to a reduced pain calibration. In some cases, a shift of a protuberance(s) of 2 mm is repeated between 1-3 times until reaching the desired effect. In some cases, the process can include shifting more than 3 times of over 2 mm, to eventually 1 cm or more from the "Balanced" position, until the desired effect is achieved. As long as the shift does not result in excessive eversion or inversion.

Example 1

Treatment of a Subject (Patient) Having a Central Spinal Stenosis

A 52 years old man was presented to the treatment center with a diagnosis of central spinal stenosis.

Case History:

2 years ago the patient was involved in a working accident in which he fell backwards on his back from the scaffolding in a construction site. He was rushed to the hospital complaining of severe low back pain. A computerized tomography scan (CT scan) revealed that the L3-L4 disc was protruded and causing a mild to moderate narrowing of the central spinal canal. The patient refused surgery and was released after being hospitalized for three days for observation. Since then his condition worsened and he started suffering from symptoms referred to both legs. He reported having pain and a sensation of heaviness in both calves during walking (for over 20 minutes) and standing (for over 10 minutes). These symptoms were relieved only if he sat down. He also reported having night cramps in both calves and feet which woke him every night.

Physical Examination:

On observation the patient has hypolordosis and stands in slight forward trunk lean. Leg alignment (hips, knees, ankles and feet) is normal. Functional tests—the patient performs a full squat without difficulty or symptoms and is able to walk on his tip toes and on his heels without difficulty (These tests are used as a functional muscle strength assessment in order to ascertain any neurological weakness to major muscle groups). Clinical gait assessment shows the patient walks with small steps and small amplitude of arm swing. Test for spinal stenosis (part 1) showed that the patient was able to walk for 7 minutes and 26 seconds before he started feeling mild pain in the right calve (this test will be repeated later with the device in order to assess the functional impact of the device on the patients symptoms). Back range of motion is full in forward flexion and left and right rotations. It is limited to 75% of normal range in both left and right side flexion and limited to 20% of normal range in extension. Sustained extension (spinal stenosis test) produces pain and paraesthesia in both calves after 30 seconds. A neurological assessment revealed reduces Achilles reflex bilaterally, mild hypoesthesia in the posterior aspect of both calves and plantar aspects of both feet (S1-S2 dermatomes). Straight leg raise (SLR) was bilaterally limited to 45 degrees due to pain in the posterior aspect of the thigh and calve. Manual muscle testing did not reveal any weakness.

Gaitlab and Imaging:

A magnetic resonance imaging (MRI) performed 4 months prior to the date of the consultation shows mild to moderate narrowing of the central spinal canal due to a protrusion of L3-L4 disc and a central disc bulge of the L4-L5 disc, without narrowing of the spinal canal. There were degenerative changes to the facet joints bilaterally at L3-L4, L4-L5 and L5-S1. Gait lab results showed a velocity of 78 cm/sec, single limb support of 39.7% in the right leg and 39.2% in the left leg. Left step length: 47.0 cm Right step length: 46.1 cm.

Therapy:

Bulbous Protuberances (BPs):

Identical BPs with B convexity and "soft" resilience were attached and fixed to the footwear under the hind foot and fore-foot of the left and right device. A 100 gr. weighted spacer (disc) of 2.5 mm height was attached and fixed between the device and the posterior BP under the left leg and the right legs. In order to maintain the anterior BPs at the same height so as not to create a plantar flexed position a hard spacer and a soft spacer was introduced and fixed between the anterior BP and shoe both under the left leg and the right leg.

Balancing Process:

The device was calibrated and fine tuned during repeated clinical gait assessments. During this process care was taken to reduce the eversion and inversion during heel strike, loading response, mid-stance and toe-off. In this particular case, the balanced position is medial to the longitudinal axis of the device (system)

Pain:

In order to reduce pain in the lumbar spine, the posterior B.P.'s were calibrated and fixed 15 mm more posterior and 4 mm medially to the balanced position. The patient was asked to walk 20 meters with the device and he then reported feeling no lumbar pain, and his gait was balanced. In order to reduce pain in the calves, two additional hard spacers were added and fixed under the anterior BPs of both the right and the left units. This brought both ankles to a dorsiflexed position. During the repeated gait assessment the patient reported feeling no pain or heavy sensation in the calves.

Heel-Rise Timing:

The patient was asked to walk 10 meters back and forth in order to confirm that the gait is balanced with regard to ankle inversion and/or eversion angles and that the heel-rises in an appropriate timing. It was noted that the patient had an early heel-rise in both the right and left legs. In order to correct the early heel rise one of the hard spacers in the anterior B.P.'s was changed to soft spacers, bringing both feet to a slightly less dorsiflexed position. The patient was observed walking with the device and the timing of the heel rise was noted to have been corrected in the left leg. At this point the test for spinal stenosis (part 2) was repeated and the patient was able to walk for 11 minutes before reporting pain in the right calve (an improvement to the 7 minutes and 26 seconds to the appearance of pain while walking barefoot, this indicates a potential for improvement with the device).

Treatment Plan:

As was described above the patient felt an immediate relief in pain when walking with the device during the initial consultation. The patient was now briefed with safety instructions and was asked to wear the device at home for 30 minutes a day on each day of the first week of the treatment. Out of this total wearing time he was instructed to spend an accumulative time of 5-8 (about 20% of total wearing time minutes) in weight bearing activities (walking or standing while performing daily routine—see item 3 in the clarification section). Patient was instructed to increase overall daily wearing time of the device by 10 minutes every week for the initial 3 weeks, reaching 60 minutes wearing time with the device every day, while maintaining the 20% accumulative weight bearing time (thus reaching an accumulative weight bearing time of approximately 10-15 minutes). The patient was seen for follow-up consultations at the treatment center 3 weeks after his first visit, 8 weeks after his first visit, and 5 months after his first visit. Each follow up consultation consisted of a Gaitlab test, an interview performed by the treating Therapist (including report of current symptom level rated on a VAS and report of difficulty in function), a clinical assessment of gait without and with the device and a treatment plan for the duration of time till the next follow up.

Treatment Progression:

In the first follow up consultation the patient reported that he found simple house chores (such as making a cup of coffee) much easier while wearing the device. A barefoot gait lab test (see table no. 1) showed an increase in gait velocity (88 cm/second) and increases in both left and right step lengths (51 cm. in both). The patient was then instructed to continue to increase the overall wearing time of the device by 10 minutes per week while maintaining an accumulative weight bearing time of 20%. In the second follow up consultation the patient reported he has reached an overall wearing time of 2 hours and 10 minutes per day. He reported that he had no difficulty in standing and cooking for as long as 30 minutes with the device and that his night cramps were significantly reduced. When inquired about outdoor activities he reported that he still found walking painful after about 30 minutes (a 10 minute improvement to the baseline). A barefoot gait lab test revealed that step lengths in both the right and the left legs and gait velocity have improved (see table no. 1 for details). A clinical gait assessment without the device showed improved arm swing.

In order to increase the level of perturbation, the anterior and posterior B.P.'s in both units of the device were changed to a C convexity with soft resilience. A clinical gait assessment showed that the heel rise timing was normal and the patient reported feeling comfortable while walking with the device. He was then instructed to maintain the 2 hour and 10 minutes of wearing time of the device for the next 2 weeks so that he has time to adjust to the new level of perturbation. If he continued to feel comfortable with the device he was told to add 5 minutes of outdoor walking with the device starting from the third week, in addition to the above period of indoor wearing time. He was instructed to increase the outdoor walking by 5 minutes per week up to a maximum of 30 minutes per week.

In the third follow up consultation the patient reported he had the device on for 3 hours a day out of which he walked outside for 30 minutes. He reported that he started feeling pain and heaviness in his feet (but not in his calves) after about 45 minutes of walking with regular shoes. A barefoot gait lab test showed that his gait velocity and step lengths were further improved (see Table no. 1, below). He was instructed to maintain this amount of wearing and no further changes were made in the calibration of the device. After the initial 5 months the patient continued to come for follow-up consultations 2-3 times a year.

TABLE 1

| Patient's gait parameters: | | | | | |
|---|---|---|---|---|---|
| Right Single Limb Support (in % of step cycle) | Left Single Limb Support (in % of step cycle) | Right Step length (cm) | Left step length (cm) | Velocity (cm/sec) | Visit |
| 39.2 | 39.7 | 46 | 47 | 78 | $1^{st}$ (initial) |
| 39.5 | 39.3 | 51 | 51 | 88 | $2^{nd}$ (first follow-up) |
| 29.4 | 39.1 | 55 | 53 | 95 | $3^{rd}$ (second follow-up) |
| 39.0 | 39.3 | 57 | 58 | 101 | $4^{th}$ (third follow-up) |

Example 2

Treatment of a Subject (Patient) Having a Nerve Root Compression and Drop Foot A 40 years old woman was presented to the treatment center with a diagnosis of L5-S1 nerve root compression and right drop foot.

Case History:

the patient reports that she had bouts of low back pain with radiating symptoms to the right leg for 10 years. 4 months ago she started having severe pain in the lateral aspect of her right calve. The pain started insidiously but was accompanied by hypoesthesia. Within a week she started having difficulty in walking and was referred to the emergency room by her treating physician. She underwent laminectomy, disectomy and fusion of the L5-S1 level. The surgery relieved the pain and hypoesthesia significantly, but the difficulty on walking remained. She currently reports she finds walking on uneven ground difficult due to poor clearance of her right foot. She still suffers from constant pain in the L5 dermatome (VAS 3/10). She also has pain in the lumbar area during prolonged standing (25 minutes, VAS 4/10) and prolonged sitting (1 hour, VAS 2/10). Both these pains are relieved by movement, such as walking.

Physical Examination:

On observation the patient has hyperlordosis. Knee alignment was in mild valgus and an apparent atrophy of the gastro-soleus complex of the right leg was observed. Functional tests—the patient performed a full squat without difficulty or symptoms. When weight bearing on the right leg during walking on tip toes the right foot drops about 4 cm. but does not reach the ground. Clinical gait assessment shows the patient uses high stepping gait during right swing. Back range of motion was full in forward flexion and rotation. Side flexion (left and right) was limited to 80% of normal range without symptoms. Extension caused the pain in the right calve to increase at 80% of normal range. A neurological assessment showed hypoesthesia in the right L5 dermatome and a reduced right Achilles reflex. Manual muscle testing revealed that the right extensor digitorum longus, extensor hallucis longus and tibialis anterior were all weak and rated at −4/5. SLR was limited on the right to 50 degrees while the left was normal (75 degrees).

Imaging and Gait Lab:

The patient had imaging (MRI) performed prior to surgery and this showed a protruded L5-S1 disc compressing the L5 right nerve root. Gait lab results revealed slow gait velocity 102 cm/sec, left step length: 53 cm. right step length: 57 cm. left single limb support 41.8 and right single limb support 35.7 (see Table 2 for gait lab results).

Therapy:

Bulbous Protuberances (BPs):

Identical BPs with B convexity and "soft" resilience were attached and fixed to the footwear under the hind foot and fore-foot of the left and right device. A 100 gr. weighted spacer (disc) of 2.5 mm height was attached and fixed between the device and the anterior BP under the left leg and the right legs. This was done in order to functionally strengthen the dorsiflexors during swing.

Balancing Process:

The patient's device was calibrated and fine tuned during repeated clinical gait assessments. During this process care was taken to reduce the eversion and inversion during heel strike, loading response, mid-stance and toe-off.

Pain:

In order to maintain the ankles at a dorsiflexed position, which is assumed to bring the lumbar spine to a more flexed position (lumbar extension elicited pain during physical assessment), no spacers were added to the posterior B.P.'s in either the right or the left units of the device. A dorsiflexed position also allows better clearance during swing. The patient was asked to walk 20 meters with the device again and she reported feeling back pain (VAS 1/10) and right calve pain (3/10). Clinical assessment of her gait showed that her clearance was improved and the high stepping gait was reduced. In order to reduce pain in the lumbar spine the posterior B.P.'s were calibrated and fixed 10 mm more posterior and 4 mm medially to the balanced position. The patient then reported feeling no lumbar pain while walking with the device and her gait was balanced, the leg pain persisted at a level of 2/10. In order to reduce her leg pain one hard spacer was inserted and fixed under the anterior and posterior B.P.'s of the right unit. This calibration, called "off-loading", is supposed to make swing of the contra-lateral leg easier by increasing the height of the device in the involved leg. In this case the difficulty in left swing is demonstrated by the gait lab results: shorter step length of the left leg and the low single limb support on the right. The patient was asked to walk 20 meters and she reported that the pain in the right leg was now at a level of discomfort and not pain.

Heel-Rise Timing:

The patient was asked to walk 10 meters back and forth in order to confirm that the gait is balanced with regard to ankle inversion and/or eversion angles and that the heel-rises in an appropriate timing. No apparent gait deviations were observed.

Gaitlab Retest:

Once the balancing process was completed the patient performed another gaitlab test with the device. The results of this test were significantly better than the baseline results. Gait velocity increased to 118 cm/sec., left single limb support: 38.5%, right single limb support 37.3%, left step length 58 cm. and right step length was 60 cm. (see Table 2). It is believed that as the treatment progresses and the patient wears the device for longer periods of time Treatment Plan:

As was described above the patient felt a significant relief in pain when walking with the device during the initial consultation. The patient was now briefed with safety instructions and was asked to wear the device at home for 30 minutes a day on each day of the first week of the treatment. Out of this total wearing time she was instructed to spend an accumulative time of 5-8 (about 20% of total wearing time minutes) in weight bearing activities (walking or standing) while performing daily routine. She was instructed to increase overall daily wearing time of the device by 15 minutes every week for the initial 3 weeks, reaching 75 minutes of wearing time with the device every day, while maintaining the 20% accumulative weight bearing time (thus reaching an accumulative weight bearing time of approximately 15-18 minutes). The patient was seen for follow-up consultations at the treatment center 3 weeks after her first visit, 6 weeks after her first visit, 3 months after her first visit and 6 months after the first consultation. Each follow up consultation consisted of a Gaitlab test, an interview performed by the treating Therapist (including report of current symptom level rated on a VAS and report of difficulty in function), a clinical assessment of gait without and with the device and a treatment plan for the duration of time till the next follow up.

Treatment Progression:

In the first follow up consultation the patient reported that while she did feel less pain with the device she did not notice any improvement without it. Her barefoot gait lab results showed some improvement indicated by better symmetry in step length (left 54 cm. right 57 cm.) and single limb support (left 41.2 right 36.3) along with a mild increase in gait velocity (108 cm/sec) (see table 2 for results). She was instructed to keep increasing the wearing time of the device by 15 minutes per week, reaching 2 hours by the next follow up consultation. She was instructed to maintain 20% of accumulative weight bearing time.

In the next follow up consultation the patient reported that she wears the device for 2 hours each day. She felt an improvement in her gait without the device and reported that she had less incidents of her right foot failing to clear the ground during swing. Her pain was also reduced to a level of 1-2/10 in the right leg and in her lower back. The gait lab results showed further improvement in comparison to the first follow up consultation (see table no. 2). Gait velocity has improved to 118 cm/sec, left step length to 56 cm, right step length to 58 cm., left single limb support to 40.4% and right single limb support to 37.8%. Clinical gait assessment showed a reduction in high stepping gait and manual muscle testing showed muscle strength of the right extensor digitorum longus, extensor hallucis longus and tibialis anterior improved to −5/5. The hard spacers on the anterior and posterior B.P.'s of the right unit which were used for offloading were removed and the B.P.'s were fixed in the same position. The patient was asked to walk with the device and did not report any pain or symptoms. In order to increase the level of perturbation the posterior B convexity caps of the right and left units were changed to caps with a C level of convexity. Since the posterior B.P.'s with the C caps were now higher than the anterior B.P's with the B convexity caps, the dorsiflexion in the ankles was lost. In order to regain the dorsiflexion a soft and a hard spacer were inserted and fixed under the anterior B.P.'s of both the right and the left units. The patient was asked to walk with the device and reported she felt comfortable with it. Her gait was observed to be well balanced and heel rise timing appeared normal. The patient was instructed to maintain the 2 hours a day of wearing the device for the next two weeks in order to allow her to get used to the new device calibration. She was then instructed to begin walking outdoors with the device for 5 minutes per day in addition to the 2 hours indoors. Provided she felt comfortable walking outdoors (no fatigue or increased symptoms) she was instructed to increase the outdoor walking by 5 minutes every week, up to a maximum of 30 minutes. The patent was further instructed to continue wearing the device indoors for 2 hours a day.

In the third follow up consultation the patient reported she enjoyed walking outdoor with the device and could walk for 30 minutes without difficulty pain or symptoms. She also continued wearing the device at home for 2 hours each day. She reported that she no longer had any back or referred leg pain unless she over exerted herself (for example, cooking for a period exceeding 2 hours). Her barefoot gait lab results showed further improvement (see table no. 2 for details). A manual muscle testing of the relevant muscles did not show any weakness. Walking on tip toes showed only a minor drop of the right foot (0.5 cm. in comparison to 4 cm. during the initial physical examination). In order to increase the level of perturbation the anterior caps of the right and left B.P.'s were changed from a B convexity to a C convexity. In order to maintain the same degree of dorsiflexion the hard and soft spacers added to the anterior right and left B.P.'s in the previous follow up consultation were removed and the B.P.'s were fixed in the same position. The patient was asked to walk 20 meters with the device and her gait was well balanced. She reported feeling comfortable with the device and was instructed to maintain the same amount of usage of the device, both indoors and outdoors.

In the fourth follow up consultation the patient reported that she did not notice any further improvement in her condition. Barefoot gait lab results, manual muscle testing and clinical gait assessment revealed results similar to the previous follow up consultation. Since the last changes in the calibration of the device (in the third follow up consultation) did not cause any further improvement in the patient's condition, no further changes were made in the calibration. The patient was instructed to maintain the amount of wearing the device.

After the initial 6 months the patient continued to come for follow-up consultations 2-3 times a year.

TABLE 2

| Patient gait parameters: | | | | | |
|---|---|---|---|---|---|
| Right Single Limb Support (in % of step cycle) | Left Single Limb Support (in % of step cycle) | Right Step length (cm) | Left step length (cm) | Velocity (cm/sec) | Visit |
| 35.7 | 41.8 | 57 | 53 | 102 | $1^{st}$ (initial) |
| 37.3 | 38.5 | 60 | 58 | 118 | Retest with the device |
| 36.3 | 41.2 | 57 | 54 | 108 | $2^{nd}$ (first follow-up) |
| 37.8 | 40.4 | 58 | 56 | 115 | $3^{rd}$ (second follow-up) |
| 38.3 | 39.8 | 63 | 61 | 129 | $4^{th}$ (third follow-up) |
| 38.7 | 39.5 | 61 | 60 | 127 | $5^{th}$ (fourth follow-up) |

Example 3

Treatment of a Subject (Patient) Having a Non-Specific Low Back Pain (NSLBP)

A 55 years old woman was presented to the treatment center with a diagnosis of Non-Specific Low Back Pain (NSLBP).

Case History:

The patient reports that for the past 3 years she has suffered from pain in the lower back and right buttock area. The pain has started after a bout of strenuous activity (cooking and decorating) but she rules out any trauma. Over the time that has elapsed since the pain began she has tried physiotherapy, alternative medicine (Ayurveda) and swimming, none of which significantly relieved her pain. She reports that she is now limited in her daily activities due to pain. She is unable to stand for more than 25 minutes (VAS 5/10 in the lower back), getting up after prolonged sitting causes low back pain (VAS 6/10 which reduces to 2/10 after a minute of walking), as does bending down (VAS 6/10). She reports that when the pain in her back worsens she has pain in her right buttock and over the area of the lateral right thigh (non-dermatomal pain distribution). An MRI performed six months prior to the consultation has shown mild degeneration of the L3-L4-L5-S1 discs, without any herniation or pressure on neural structures.

Physical Examination:

On observation the patient is hyperlordotic, leg alignment (hips, knees, ankles and feet) is normal. Functional tests: the patient performs a full squat without difficulty or symptoms and is able to walk on his tip toes and on his heels without difficulty. Clinical gait assessment revealed reduced arm swing bilaterally and reduced pelvic rotation, both of which are considered indicative for bracing of the lumbar and thoracic musculature. Back range of motion was: lumbar extension 75% of normal ROM, right side flexion 50% of normal ROM (she reports pain and stiffness in the right lumbar area VAS 2/10), left side flexion 80% of normal ROM (she reports a stretching sensation on the right side of her lumbar region). Right and left rotations are within normal limits. When asked to perform lumbar flexion the patient was apprehensive, when she performed the movement she was able to complete 50% of normal range before complaining of right and left lumbar pain (VAS 6/10). A neurological assessment did not reveal any significant findings. SLR were 80 degrees bilaterally and did not produce any pain.

Gaitlab and Imaging:

An MRI performed six months prior to the consultation has shown mild degeneration of the L3-L4-L5-S1 discs, without any herniation or pressure on neural structures. Gaitlab results showed gait velocity of 68 cm/sec, left step length if 52.1 cm, right step length 51.5 cm., left single limb support was 40.2 in the left leg and 39.0 in the right.

Therapy:

Bulbous Protuberances (BPs):

Identical BPs with C convexity and "soft" resilience were attached and fixed to the footwear under the hind foot and fore-foot of the left and right units.

Balancing Process:

The patient's device was calibrated and fine tuned during repeated clinical gait assessments. During this process care was taken to reduce the eversion and inversion during heel strike, loading response, mid-stance and toe-off. In this particular case, as is common in most spinal cases, the balanced position is medial to the longitudinal axis of the device (device).

Pain:

The patient reported she still felt low back pain after the above calibration was performed (VAS 3/10). In order to reduce pain in the lumbar spine the posterior B.P.'s were calibrated and fixed 12 mm more posterior and 3 mm medially to the balanced position. The patient was asked to walk 20 meters with the device and she then reported feeling her lumbar pain was reduced (VAS 1.5/10). In order to reduce the pain further a hard spacer was inserted and fixed between the posterior right and left B.P.'s and the sole of the device. This brings the ankle to a plantar flexed position which is believed to bring the pelvis and lumbar spine to a more extended (anterior pelvic tilt) position. This was considered to be beneficial since the strongest pain was produced in lumbar flexion. The patient was asked to walk with this new calibration and reported her pain had decreased further to a level of a mere discomfort. Clinical gait assessment revealed that her gait was balanced.

Heel-Rise Timing:

The patient was asked to walk 10 meters back and forth in order to confirm that the gait is balanced with regard to ankle inversion and/or eversion angles and that the heel-rises in an appropriate timing. No visible gait deviations were seen.

Treatment Plan:

As described above, the patient felt pain immediate relief when walking with the device during the initial consultation and her gait was well balanced. The patient was now briefed with safety instructions. Since her step length's were decreased in comparison to the normal values (see table no. 3) her back musculature was considered too weak to cope with prolonged periods of wearing the device. She was therefore asked to wear the device at home for 20 minutes a day on each day of the first week of the treatment. Out of this total wearing time she was instructed to spend an accumulative time of 10%-15% (2-3 minutes) in weight bearing activities. Patient was instructed to increase overall daily wearing time of the device by 5 minutes every week for the initial 3 weeks, reaching 35 minutes wearing time with the device every day, while maintaining the 10-15% accumulative weight bearing time (thus reaching an accumulative weight bearing time of approximately 4-5 minutes). The patient was seen for follow-up consultations at the treatment center 3 weeks after her first visit, 6 weeks after her first visit, 14 weeks after her first visit and 6 months after the initial consultation. Each follow up consultation consisted of a Gaitlab test, an interview performed by the treating Therapist (including report of current symptom level rated on a VAS and report of difficulty in function), a clinical assessment of gait without and with the device and a treatment plan for the duration of time till the next follow up.

Treatment Progression:

In the first follow up consultation the patient reported that although she felt comfortable with the device on, she did not notice much of a change in her pain level or disability. A barefoot gait lab test (see table no. 3) showed an increase in gait velocity (88 cm/second) and increases in both left (52.1 cm.) and right (51.5 cm.) step lengths. In addition, the single limb support became more symmetrical (left 39.8, right 39.4) which is considered an improvement in motor control of gait. The patient was then instructed to continue to increase the overall wearing time of the device by 10 minutes per week while maintaining an accumulative weight bearing time of 10-15%. In the second follow up consultation the patient reported that she felt a decrease in pain during prolonged standing (VAS 2/10 after 45 minutes, an improvement in pain level and the amount of time she was able to stand). She has reached an overall time of an hour and ten minutes with the device, and felt she had very little pain when she had the device on. She reported that even standing after sitting was much less painful. Her gaitlab results showed further improvement in velocity and step lengths, the latter reaching normal values (see table 3). In order to increase the effect of the device the posterior B.P.'s of both the right and the left units were changed from a C convexity with a soft resilience to a D convexity with a soft resilience. The patient was asked to walk with the device and a late heel rise was observed bilaterally. This was attributed to the increase in the height of the posterior B.P.'s due to the increased convexity (the dorsiflexion was now lost since the D convexity is higher than the former C convexity). A hard spacer was inserted and fixed between the anterior B.P.'s and the sole of the left and right units. The patient was asked to walk again with the device and the late heel rise was observed to be corrected. She was then instructed to maintain the overall hour and ten minutes of wear time for the following two weeks in order to allow her to get used to the increased perturbation induced by the newly added D convexity. In the weeks following the first two the patient was instructed to increase the overall wearing time by 15 minutes per week, up to a maximum of three hours.

In the third follow up consultation (14 weeks after the initial consultation) the patient reported she occasionally felt pain in her lower back after standing for over three hours, the pain in the right buttock and the right thigh was completely alleviated. Her gaitlab results showed further improvement in velocity and left and right step lengths (128 cm/sec, 60.0 cm., 59.6 cm. Respectively, see table no. 3). During clinical gait assessment the arm swing and pelvis rotation was observed to be normal. This is considered an indication of a reduction of the bracing of spinal muscles, which is supported by the continuous improvement in gaitlab results. She was instructed to reduce the indoor overall wearing time to 2.5 hours and start performing outdoor walking for 10 minutes per day. She was asked to increase the outdoor walking by 5 minutes per week, to a maximum of 30 minutes.

In the fourth follow up consultation she reported having no problem with prolonged standing or sitting. She mentioned she felt free to bend down (lumbar flexion) and felt only a mild discomfort in her back while doing so. Nonetheless, she was urged to try to use a squat rather than lumbar flexion in order to bend forward. She was asked to maintain the 2.5 hours of indoor ADL and the 30 minutes of outdoor walking with the device. Following this, the patient was seen for follow up consultations every 4-6 months in order to continue to monitor her function and pain levels and regulate the treatment.

TABLE 3

Patients gait parameters:

| Right Single Limb Support (in % of step cycle) | Left Single Limb Support (in % of step cycle) | Right Step length (cm) | Left step length (cm) | Velocity (cm/sec) | Visit |
|---|---|---|---|---|---|
| 39.0 | 40.2 | 51.5 | 52.1 | 68 | $1^{st}$ (initial) |
| 39.4 | 39.8 | 52.4 | 53 | 88 | $2^{nd}$ (first follow-up) |
| 39.4 | 39.1 | 55.4 | 55.2 | 102 | $3^{rd}$ (second follow-up) |
| 39.0 | 38.9 | 59.6 | 60.0 | 128 | $4^{th}$ (third follow-up) |
| 39.1 | 38.7 | 60.8 | 60.1 | 130 | $5^{th}$ (fourth follow-up) |

Example 4

Treatment of a Subject (Patient) Having an Osteoporotic (Burst) Fracture of the Body of L1

A 78 years old woman diagnosed with a fracture in the L1 vertebra, was presented to the treatment center.

Case History:

the patient had intermittent back pain more than 25 years. A year prior to her arrival, this pain was dramatically increased following an accident in which she fell from a chair on her buttocks. An X-ray micrograph revealed a partially collapsed compression fracture of the body of the L1 vertebra. Following the fracture she had bone density scan which revealed T −3.1 in L4-5 and T −2.3 in the femur's neck. She was prescribed alendronate (Fosalan) once a week. At the time, she reported that walking (15 minutes, VAS 4/10) and standing (5 minutes, VAS 5/10) aggravate her pain which is located in the low back. Bending forward (flexion) also increases her pain. To relieve the pain she had to lie down.

Physical Examination:

On observation the patient had a pelvic alignment of posterior pelvic tilt, hypo-lordosis and a as well as a hyper-kyphosis of the thoracic spine. Hip and knee alignment was normal. Lumbar movements reproduced her pain at 50% of the normal flexion range of motion and 80% of the normal extension range of motion. During clinical gait assessment decreased pelvic, lumbar and thoracic rotation which led to a reduction in arm swing was observed. The patient also reported of lumbar pain during the gait assessment which she rated verbally as 3/10. Neurological assessment of motor function and sensation in the lower limbs was normal.

Imaging and Gait Lab:

X-rays revealed a typical wedge shape of the vertebral body of L1. In addition a narrowing of the intervertebral disc space was observed in the L4-5 and L5-S1 segments, accompanied by degenerative changes of the facet joints in these segments. Gait lab results revealed slow gait velocity at 87 cm/sec, with short step lengths (left step length: 48 cm. right step length: 48 cm). Left single limb support was 38.7 and right single limb support was 39.1 (see Table 4 for gait lab results).

Therapy:

Bulbous Protuberances (BPs):

Identical BPs with B convexity and "soft" resilience were attached and fixed to the footwear under the hind foot and fore-foot of the left and right device.

Balancing Process:

The patient's device was calibrated and fine-tuned during repeated clinical gait assessments. During this process care was taken to reduce the eversion and inversion during heel strike, loading response, mid-stance and toe-off.

Pain:

In order to reduce the pain in the lumbar region, a hard spacer was attached and fixed between the device and the posterior BP under the left leg and the right legs. This created a slightly plantar flexed position of both ankles, inducing a more extended position of the lumbar spine. The patient was asked to walk 20 m with the device and she reported a reduction of back pain (VAS 1/10). In order to further reduce the pain, the posterior BPs were recalibrated to a more posterior position (2 mm posteriorly). The patient then reported of no lumbar pain while walking with the device and her gait was observed to be balanced.

Heel-Rise Timing:

The patient was asked to walk 10 m back and forth in order to confirm that the gait is balanced with regard to ankle inversion and/or eversion angles and that the heel-rises are in an appropriate timing. No apparent gait deviations were observed.

Treatment Plan:

Upon the completion of the calibration process the patient had a significant decrease in lumbar pain. The patient was then briefed with safety instructions and was asked to wear the device at home for 25 minutes for the first week of the treatment. Out of this total wearing time she was instructed to spend an accumulative time of 3-4 (about 15% of total wearing time minutes) in weight bearing activities (walking or standing) while performing daily routine. She was instructed to increase overall daily wearing time of the device by 10 minutes every week for the initial 3 weeks, reaching 55 minutes of wearing time with the device every day, while maintaining the 15% accumulative weight bearing time (thus reaching an accumulative weight bearing time of approximately 8-10 minutes). The patient was seen for follow-up consultations at the treatment center 3 weeks after her initial consultation, 9 weeks after her initial consultation and 4 months after her initial consultation. Each follow up consultation consisted of a gait lab test, an interview performed by the treating physiotherapist (including report of current symptom level rated on a VAS and report of difficulty in function), a clinical assessment of gait with and without the device and a treatment plan for the duration of time till the next follow up.

Treatment Progression:

In the first follow up consultation the patient reported of feeling comfortably with minor household chores while wearing the device. She also mentioned that her back feels slightly less stiff when she stands up after prolonged sitting. Her barefoot gait lab results showed some improvement and indicated a small increase in step length (left 49 cm. right 50 cm.) and velocity (95 cm/sec) (see table 4 for results). The patient was then observed walking without and with the device. Her gait in both cases was regarded as balanced and so no changes were made to the calibration of the BPs. She was instructed to keep increasing the total wearing time of the device by 15 minutes per week, reaching 145 minutes by the next follow up consultation. She was instructed to maintain 15% of accumulative weight bearing time.

In the second follow up consultation the patient reported that she is able to stand for an hour with a pain level of 1/10. Her walking, with her regular shoes, was also improved and she reported that now she is able to walk for half an hour with only some discomfort in her back. The patient reported that she wears the device for 2.5 hours each day and felt comfortable with it. The gait lab results showed further improvement in comparison to the first follow up consultation (see table no. 4). Gait velocity has improved to 105 cm/sec, left step length increased to 52 cm, right step length to 53 cm. Single limb support in both legs continued to be within the normal limits. Clinical gait assessment showed an increase in the rotation movement of the spine (pelvis, lumbar and thoracic) resulting in improved arm swing. Gait assessment with the device was balanced. In order to increase the challenge (induce muscle build-up) to the muscular system the caps of the posterior BPs were changed to a C level of convexity with soft resilience. Since the C caps are higher than the B caps, an increase in plantar flexion was introduced. In order to avoid this increase, the two hard spacers inserted between the posterior BPs and the device were removed from both right and left devices, and the BPs were fixed to their previous position. The patient was asked to walk with the device and did not report any pain or symptoms. Her gait was observed to be well balanced and heel rise timing appeared normal. The patient was instructed to decrease the overall wearing time of the device to 1.5 a day of wearing the device for the next two weeks in order to allow her to get used to the new device calibration. Following this period, she was asked to increase the wearing time by 20 minutes per week to a maximum wearing time of 4 hours.

In the third follow up consultation the patient reported she enjoyed wearing the device daily for 4 hours while performing household tasks. She also reported on her new ability of walking outdoors for an hour with regular shoes before the back pain appears. Her gait lab results showed further improvement (see table 4) with step length reaching 58 cm. and 59 cm. for the left and the right respectively. Velocity increased to 118 cm/sec and both velocity and step lengths were now within normal limits. The patient was then went through gait assessment while walking with and without the device and her gait was observed to be without any deviations. No further changes were made to the calibration of the device and the patient was asked to continue to wear the device daily for 4 hours.

After the third follow up consultation the patient continued to come for follow-up consultations 3 times a year in order to verify that she continued to feel well and that her calibration remained balanced.

TABLE 4

| Patient gait parameters: | | | | | |
|---|---|---|---|---|---|
| Right Single Limb Support (in % of step cycle) | Left Single Limb Support (in % of step cycle) | Right Step length (cm) | Left step length (cm) | Velocity (cm/sec) | Visit |
| 39.1 | 38.7 | 48 | 48 | 87 | $1^{st}$ (initial) |
| 39.0 | 39.1 | 50 | 49 | 95 | $2^{nd}$ (first follow-up) |
| 38.9 | 39.2 | 53 | 52 | 105 | $3^{rd}$ (second follow-up) |
| 39.5 | 39.7 | 58 | 59 | 118 | $4^{th}$ (third follow-up) |

Example 5

Treatment of a Subject (Patient) Having Adolescent Idiopathic Scoliosis

A 13 years old girl diagnosed with idiopathic scoliosis was presented to the treatment center.

Case History:

the patient has been diagnosed with thoraco-lumbar scoliosis, 4 months prior to her arrival at the treatment center. She has not been suffering from any symptoms such as pain or discomfort in her back. She has been menstruating irregularly for the past 8 months. Her treating orthopedic surgeon has considered the use of a brace in order to prevent deterioration of the scoliosis. Both the patient and her parents were eager to avoid the use of a brace.

Physical Examination:

On observation the patient has no apparent pelvic obliquity. Her spine is hypo-lordotic and hypo-kyphotic with an apparent right main thoracic curve and a secondary left lumbar curve. Adam's test is positive with a hump apparent in the right rib cage. Ranges of motion of other spinal movements are within normal limits. Leg length measurements do not reveal any leg length discrepancy.

Imaging and Gait Lab:

X-rays revealed a right thoracic curve (Cobb angle of 33 degrees) with an accompanying right rotation of the vertebral bodies. The lumbar compensatory curve has a Cobb angle of 15 degrees. Risser sign was measured as Risser II. Gait lab results revealed normal velocity and step lengths (velocity 123 cm/sec, left step length: 57 cm. right step length: 57 cm.). Both the left and the right single limb supports were above the normal values (left 42.3, right 42.0) (see Table Y for gait lab results). The high single limb support values are considered a sign of poor muscular control around the pelvis during gait.

Therapy:

Bulbous Protuberances (BPs):

Identical BPs with C convexity and "hard" resilience were attached and fixed to the footwear under the hind foot and fore-foot of the left and right device.

Balancing Process:

The patient's device was calibrated and fine-tuned during repeated clinical gait assessments. During this process care was taken to reduce the eversion and inversion during heel strike, loading response, mid-stance and toe-off.

Alignment:

In order to improve the spine's alignment, the anterior and posterior BPs of the left device were recalibrated 3 mm to a more medial position. The patient was then asked to walk back and forth for 10 meters and her gait was observed to be balanced. She also reported she felt comfortable walking with the device. In order to support the hypo-lordosis of the lumbar spine the posterior BPs of both the left and the right devices were calibrated 4 mm anteriorly. The patient was asked to walk with the device again and her gait was again observed to be balanced. In order to improve the muscular control around the pelvis, two weighted spacers (disc), 3 mm high and 100 gr. in weight, were inserted and fixed between both the right and the left posterior BPs. In order to avoid a plantar flexed position of the ankles (caused by the insertion of the discs) one hard spacer and one soft spacer were inserted and fixed between both the right and the left anterior BPs. The patients gait was observed again and was considered balanced. An observation of her standing posture with the device showed a reduction of the lumbar and thoracic scoliotic curvatures. The patient reported that she felt comfortable walking and standing with the device.

Heel-Rise Timing:

The patient was asked to walk 10 meters back and forth in order to confirm that the gait is balanced with regard to ankle inversion and/or eversion angles and that the heel-rises in an appropriate timing. No apparent gait deviations were observed.

Treatment Plan:

The patient was asked to wear the device daily, indoors, for an hour. She was encouraged to be active while wearing the device performing such activities as walking about the house, doing her hair standing in front of the mirror etc. She was asked to increase the overall wearing time of the device by 20 minutes each week. The patient was seen for follow-up consultations at the treatment center 5 weeks after her initial consultation, 10 weeks after her initial consultation, 5 months after her initial consultation and 9 months into the treatment. Each follow up consultation consisted of a gait lab test, an interview and an observation of standing posture performed by the treating physiotherapist, a clinical assessment of gait without and with the device and a treatment plan for the duration of time till the next follow up. In addition any new X-rays were reviewed, measured and recorded.

Treatment Progression:

In the first follow up consultation the patient reported she has been wearing the device daily and has reached an overall wearing time of two hours and forty minutes. Her barefoot gait lab results showed a decrease in left and right single limb support (left 41.8, right 41.5) with a small increase in bilateral step length and velocity (see table Y for results). The patient has not been re-evaluated by X-ray but an observation of her posture during standing position revealed a small decrease in lumbar and thoracic scoliosis curvatures. The patient was then observed walking with and without the device. Her gait in both cases was regarded as balanced. In order to increase the neuro-muscular challenge introduced by the device and to enhance muscular training the caps of all BPs were changed from a "C" level of convexity to a "D" level of convexity with hard resilience. Her gait with the device was reassessed and was considered to be balanced. In order to allow her to get accustomed to the increased level of convexity (increased perturbation of the gait) she was instructed maintain the same amount of time and level of activity with the device for the next two weeks. Following these two weeks the patient was instructed to start walking outdoors with the device, starting with 15 minutes walk and increasing walking time by 5 minutes per week. She was asked to get to a maximum of 45 minutes. In addition to the outdoor walking she was asked to continue wearing the device in the house as well.

In the second follow up consultation, 10 weeks after the commencement of the treatment, the patient reported that she was doing three or four 50 minute walks with the device. In addition, she has been wearing the device in the house for 3-4 hours a day. New X-rays of her spine showed a decrease of the Cobb angle of the thoracic curvature from 33 degrees to 26 degrees. The lumbar Cobb angle decreased as well from 15 degrees to 12 degrees. The barefoot gait lab results did not show any significant changes from the previous follow up consultation (see table 5). Clinical gait assessment, both barefoot and with the device, showed a good gait pattern. The patient was encouraged to maintain the same treatment plan with the device, wearing it both outdoors and in the house as previously described.

In the third follow up consultation the patient reported she continued to wear the device according to prescribed treatment plan. She did not have any new X-rays so a careful observation of her standing posture was conducted. This revealed a further decrease of scoliotic posture as well as a decrease in thoracic vertebral rotation (assessed with the Adam's test). The patients gait was then observed and was considered well balanced. Her barefoot gait lab results showed maintained lower values of single limb support bilaterally, though these were still higher than normal values (see table 5). Due to the apparent improvements in scoliotic curvatures the anterior and posterior BPs of the left device were recalibrated and fixed 2 mm more laterally. The patients gait was observed and was considered well balanced. The patient also reported that she felt comfortable with the new calibration. She was then asked to continue wearing the device according to her current treatment plan.

In the fourth follow up consultation the patient had new X-rays with her who revealed a further decrease of the thoracic Cobb angle to 21 degrees and a 12 degree Cobb angle of the lumbar curvature. The patient reported she continued to use the device at least four times a week, doing both indoor and outdoor activities. Her gait lab results are shown in table 5. A clinical gait assessment showed that her gait was balanced and so no changes were made in the calibration of the device.

After the third follow up consultation the patient continued to come for follow-up consultations 3 times a year.

TABLE Y

| Patient gait parameters: | | | | | |
|---|---|---|---|---|---|
| Right Single Limb Support (in % of step cycle) | Left Single Limb Support (in % of step cycle) | Right Step length (cm) | Left step length (cm) | Velocity (cm/sec) | Visit |
| 42.0 | 42.3 | 57 | 57 | 123 | 1st (initial) |
| 41.5 | 41.8 | 60 | 59 | 127 | 2nd (first follow-up) |
| 41.4 | 41.5 | 60 | 60 | 125 | 3rd (second follow-up) |
| 41.3 | 41.6 | 60 | 61 | 131 | 4th (third follow-up) |
| 41.4 | 41.5 | 61 | 62 | 135 | 5th (fourth follow-up) |

What is claimed is:

1. A method of treating a subject afflicted with scoliosis comprising the steps of:

(a) securing a device to a subject's foot, whereby said device comprises a foot securing mean, a support member operably attached to said securing mean, and a relocatable anterior protuberance and a relocatable posterior protuberance, said anterior protuberance and said posterior protuberance are ground engaging;

(b) calibrating said posterior protuberance and said anterior protuberance to: a balanced position, said balanced position comprises a position whereby said device provides a reduced inversion, a reduced eversion, or both to said subject's foot during the stance phases; and (c) fixing said posterior protuberance and said anterior protuberance to said support member;

wherein said subject is able to walk, thereby treating a subject afflicted scoliosis.

2. The method of claim 1, whereby said calibrating further comprises balancing timing of heel rise.

3. The method of claim 1, whereby said calibrating comprises adjusting: (a) a resilience of said anterior protuberance, said posterior protuberance, or a combination thereof; (b) a hardness of said anterior protuberance, said posterior protuberance, or a combination thereof; (c) an elasticity of said anterior protuberance, said posterior protuberance, or a combination thereof; (d) or any combination of (a), (b), and (c).

4. The method of claim 1, whereby said calibrating comprises adjusting a height of said anterior protuberance, said posterior protuberance, or a combination thereof; (b) a convexity of said anterior protuberance, said posterior protuberance, or a combination thereof; (c) a weight of said anterior protuberance, said posterior protuberance, or a combination thereof (d) and a combination of (a), (b), and (c).

5. The method of claim 1, whereby said balanced position further comprises a position whereby reduced valgus, varus, dorsal or plantar torque about the ankle is exerted by said device on said subject's foot.

6. The method of claim 1, whereby said posterior protuberance is a bulbous protuberance, said anterior protuberance is a bulbous protuberance, or both said posterior protuberance and said anterior protuberance are bulbous protuberances.

7. The method of claim 1, whereby said anterior protuberance, said posterior protuberance, or their combination comprise a cross-section with a shape of a conic section, said conic section comprising at least one of a circle, ellipse, parabola and hyperbola.

8. The method of claim 1, whereby said anterior protuberance is shaped differently from the outer contour of said posterior protuberance.

9. A method of reducing low back pain in a subject, comprising the steps of:

(a) securing a device to a subject's foot, whereby said device comprises a foot securing mean, a support member operably attached to said securing mean, and a relocatable anterior protuberance and a relocatable posterior protuberance, said anterior protuberance and said posterior protuberance are ground engaging;

(b) calibrating said posterior protuberance and said anterior protuberance to: a balanced position, said balanced position comprises a position whereby said device provides a reduced inversion, a reduced eversion, or both to said subject's foot during the stance phases; and (c) fixing said posterior protuberance and said anterior protuberance to said support member wherein said subject is able to walk, thereby reducing low back pain in a subject.

10. The method of claim 9, whereby said calibrating further comprises balancing timing of heel rise.

11. The method of claim 9, whereby said calibrating comprises adjusting: (a) a resilience of said anterior protuberance, said posterior protuberance, or a combination thereof; (b) a hardness of said anterior protuberance, said posterior protuberance, or a combination thereof; (c) an elasticity of said anterior protuberance, said posterior protuberance, or a combination thereof; (d) or any combination of (a), (b), and (c).

12. The method of claim 9, whereby said calibrating comprises adjusting a height of said anterior protuberance, said posterior protuberance, or a combination thereof; (b) a convexity of said anterior protuberance, said posterior protuberance, or a combination thereof; (c) a weight of said anterior protuberance, said posterior protuberance, or a combination thereof (d) and a combination of (a), (b), and (c).

13. The method of claim 9, whereby said balanced position further comprises a position whereby reduced valgus, varus, dorsal or plantar torque about the ankle is exerted by said device on said subject's foot.

14. The method of claim 9, whereby said posterior protuberance is a bulbous protuberance, said anterior protuberance is a bulbous protuberance, or both said posterior protuberance and said anterior protuberance are bulbous protuberances.

15. The method of claim 9, whereby said anterior protuberance, said posterior protuberance, or their combination comprise a cross-section with a shape of a conic section, said conic section comprising at least one of a circle, ellipse, parabola and hyperbola.

16. The method of claim 9, whereby said anterior protuberance is shaped differently from the outer contour of said posterior protuberance.

* * * * *